US007115842B2

(12) United States Patent
Keane

(10) Patent No.: US 7,115,842 B2
(45) Date of Patent: Oct. 3, 2006

(54) ELECTRIC BLANKET AND SYSTEM AND METHOD FOR MAKING AN ELECTRIC BLANKET

(75) Inventor: Barry P. Keane, Seneca, SC (US)

(73) Assignee: Inotec Incorporated, Clemson, SC (US)

( * ) Notice: Subject to any disclaimer, the term of this patent is extended or adjusted under 35 U.S.C. 154(b) by 0 days.

(21) Appl. No.: 10/910,102

(22) Filed: Aug. 2, 2004

(65) Prior Publication Data

US 2005/0011880 A1 Jan. 20, 2005

Related U.S. Application Data

(62) Division of application No. 09/942,517, filed on Aug. 29, 2001, now Pat. No. 6,770,854.

(51) Int. Cl.
*H05B 1/02* (2006.01)

(52) U.S. Cl. ..... 219/494; 219/492; 219/497; 219/212; 2/905; 374/107

(58) Field of Classification Search ..... 219/212, 219/492, 497, 505, 528, 529, 545, 548, 494; 374/102, 107; 2/905
See application file for complete search history.

(56) References Cited

U.S. PATENT DOCUMENTS 3,431,611 A 3/1969 Rentz ..... 28/72.2
3,597,590 A 8/1971 Fleming
3,745,301 A * 7/1973 Sherrill et al. ..... 219/212
3,889,101 A 6/1975 Woods
3,973,066 A 8/1976 Smith, II et al.
4,031,352 A 6/1977 Oosterberg
4,034,185 A 7/1977 Crowley
4,070,217 A 1/1978 Smith, II et al.
4,074,421 A 2/1978 Reutling et al.
4,119,905 A 10/1978 Head
4,162,393 A 7/1979 Balboni
4,271,350 A 6/1981 Crowley
4,309,597 A 1/1982 Crowley
4,315,141 A 2/1982 Mills et al.
4,396,011 A 8/1983 Mack et al.
4,436,986 A 3/1984 Carlson
4,459,461 A * 7/1984 Spencer ..... 219/213
4,485,296 A 11/1984 Ueda et al.
4,503,322 A 3/1985 Kishimoto et al.
4,523,084 A 6/1985 Tamura et al.
4,554,439 A 11/1985 Cross et al.
4,625,394 A 12/1986 Kemnitz et al.
4,657,572 A 4/1987 Desai et al.
4,684,785 A 8/1987 Cole (Continued)

OTHER PUBLICATIONS

"Underwriters Laboratories, Inc. Standard for Safety, Temperature-Indicating and Regulating Equipment," *Global Engineering Documents*, UL873, ISBN 1-55989-682-5, 1994, 1995, 1996, 1998, 1999.

(Continued)

*Primary Examiner*—Mark Paschall
(74) *Attorney, Agent, or Firm*—Nelson Mullins Riley & Scarborough, LLP

(57) ABSTRACT

Electric blankets and methods and systems for making electric blankets are provided. Certain electric blanket embodiments include a laminated scrim blanket with a heating element embedded therein. Other embodiments provide an electric blanket formed from conductive fibers. Another embodiment includes a central circuit that controls the position of electricity to an electric blanket responsively to temperature rate of change. A further embodiment includes a machine for inserting a heating element within passageways of a blanket shell.

22 Claims, 20 Drawing Sheets

U.S. PATENT DOCUMENTS 5,113,058 A 5/1992 Srubas et al.
5,151,577 A 9/1992 Aspden
5,266,778 A * 11/1993 Bailey ..... 219/497
5,410,127 A 4/1995 LaRue et al.
5,420,397 A 5/1995 Weiss et al.
5,422,461 A 6/1995 Weiss et al.
5,451,747 A 9/1995 Sullivan et al.
5,521,850 A 5/1996 Moe et al.
5,582,757 A 12/1996 Kio et al.
5,683,605 A * 11/1997 Matsuoka ..... 219/497
5,770,836 A 6/1998 Weiss
5,801,914 A 9/1998 Thrash
5,824,996 A 10/1998 Kochman et al.
5,837,971 A 11/1998 Lee
5,844,207 A 12/1998 Allard et al.
5,861,610 A 1/1999 Weiss
6,222,162 B1 4/2001 Keane
6,326,596 B1 12/2001 O'Leary, et al. ..... 219/492

OTHER PUBLICATIONS

"Underwriters Laboratories, Inc. Standard for Safety, Electrically Heated Bedding" *Global Engineering Documents*, UL964, ISBN 1-55989-708-2, 1994.

* cited by examiner

FIG. 3
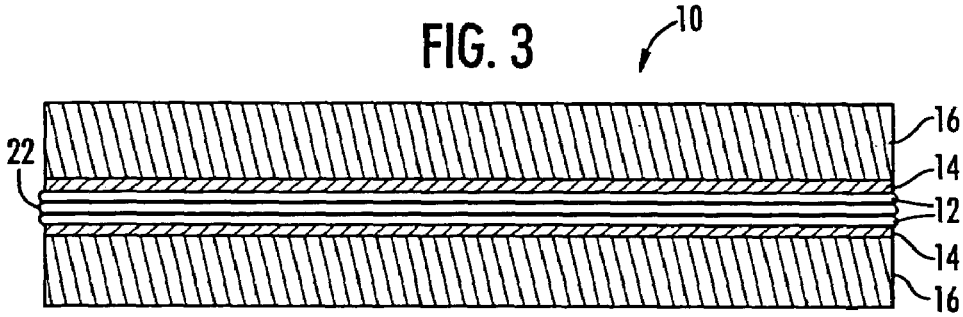
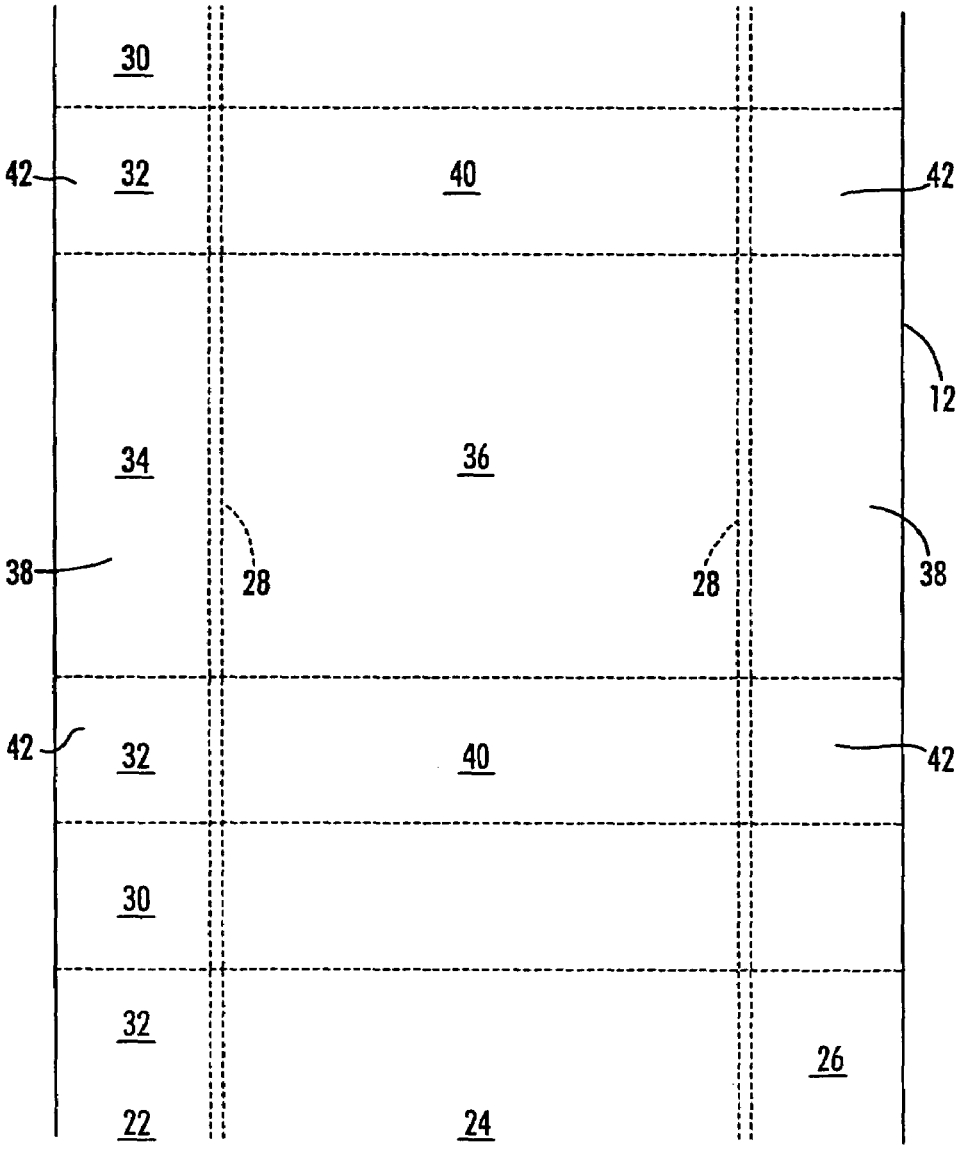
FIG. 4

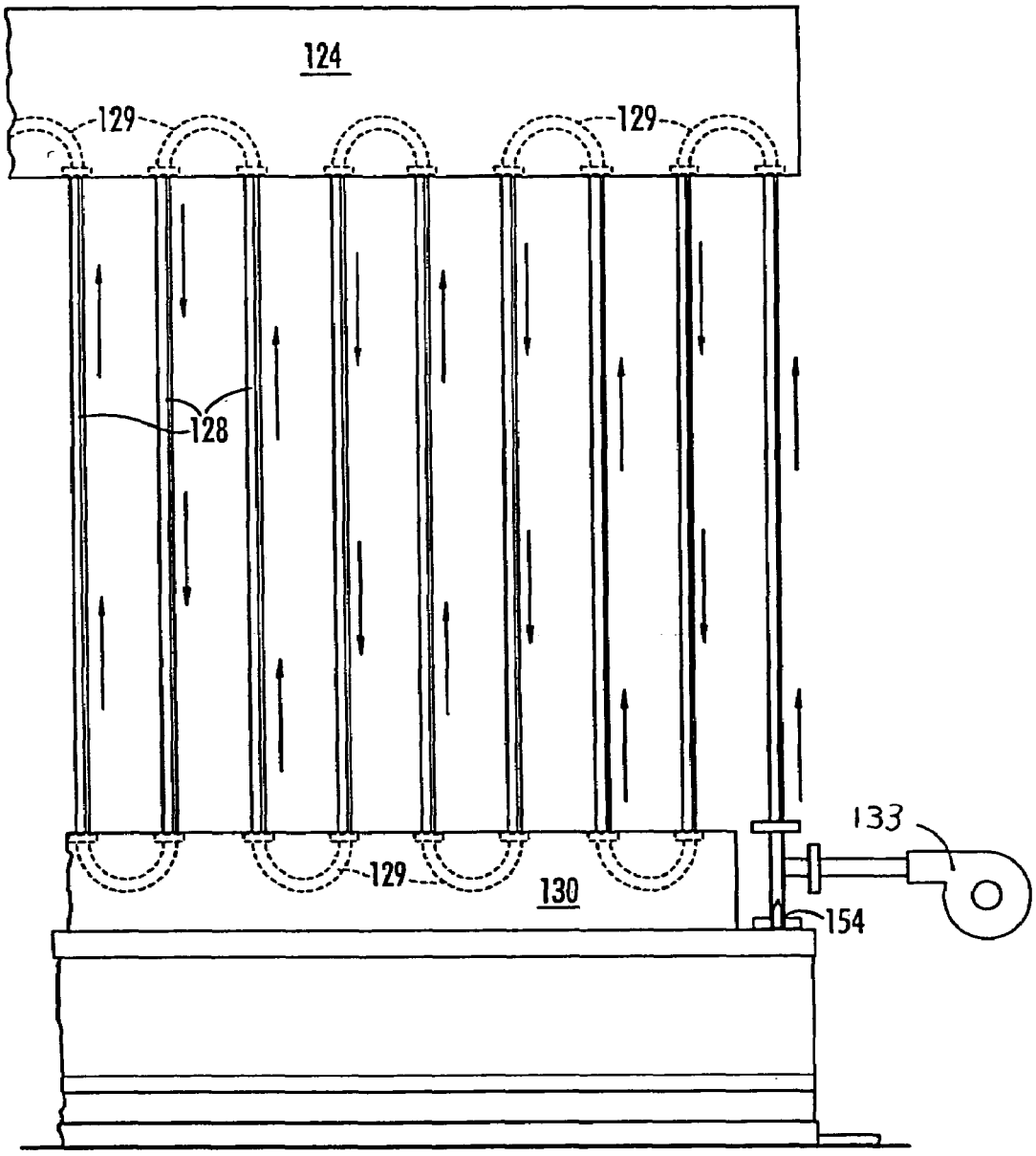
FIG. 17
FIG. 18
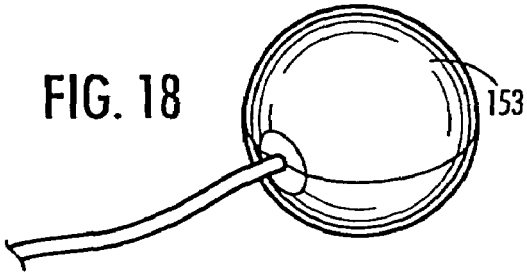

ELECTRIC BLANKET AND SYSTEM AND METHOD FOR MAKING AN ELECTRIC BLANKET

This is a division of U.S. application Ser. No. 09/942,517 filed Aug. 29, 2001 (now U.S. Pat. No. 6,770,854), the entire disclosure of which is incorporated by reference herein.

BACKGROUND OF THE INVENTION

The present invention relates generally to electric blankets.

Electric blankets typically include a heating element that extends through the blanket and through which electric current passes to generate heat. The heating element is disposed within passageways formed in the weaving process.

While not used in electric blankets, scrim laminate blankets tend to be very comfortable. FIG. 1 shows a prior art scrim laminate blanket 10. Blanket 10 includes a scrim layer 12 sandwiched between a pair of foam layers 14. As should be understood in this art, scrim is an open weave or knit fabric, typically of synthetic yarn, used primarily to improve the structural integrity of a blanket assembly. During manufacturing, a laminating line typically draws the scrim layer and foam layer together adjacent to a flame, thereby bonding the layers together so that a foam layer covers both sides of the scrim layer. From the laminating line, a flocking range applies oriented fibers 16 to one side of the blanket. An additional pass in the flocking range applies the oriented fibers to the other side of the blanket.

The present invention recognizes and addresses disadvantages of prior art constructions and methods.

The accompanying drawings, which are incorporated in and constitute a part of the specification, illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended Figures, in which:

FIG. 3 illustrates a side cross-sectional view of a blanket according to an embodiment of the present invention;

FIG. 4 illustrates a top cross-sectional view of a blanket according to an embodiment of the present invention;

FIG. 17 is a front elevational view of the blanket wire insertion machine showing the path of the shuttle when propelled through the guide tubes;

FIG. 18 is a perspective view of a shuttle according to an embodiment of the present invention;

Figure 1:
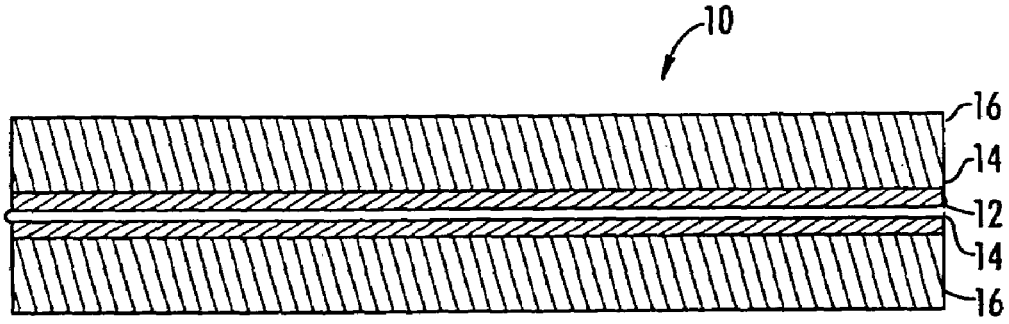
FIG. 1 illustrates a side cross-sectional view of a prior art scrim laminate blanket.

Repeat use of reference characters in the present specification and drawings is intended to represent same or analogous features or elements of the invention.

DETAILED DESCRIPTION OF THE PREFERRED EMBODIMENTS

Reference is made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can by made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Several preferred embodiments of electric blanket construction described herein include a heating element disposed in a laminated scrim blanket. The process of making a conventional scrim laminate blanket as shown in FIG. 1 should be understood in this art. Generally, a scrim layer and two foam layers on either side of the scrim layer are fed into a lamination machine that laminates the three layers together. Alternatively, the foam layers may be bonded to the scrim layer in successive steps.

Figure 22:
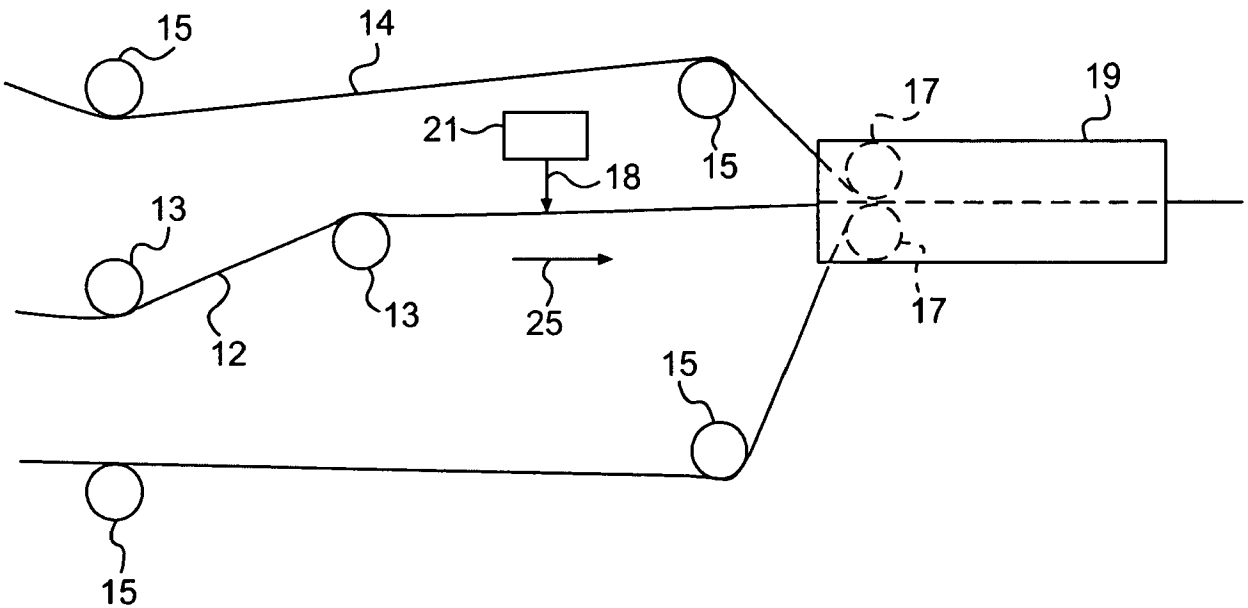
FIG. 22 is a schematic illustration of a method of making an electric blanket according to an embodiment of the present invention.

In one preferred embodiment of the present invention, a heating element is disposed on one side of the scrim layer prior to it's lamination to the foam layer on that side. Referring to FIG. 22, a scrim layer 12 and two foam layers 14 are fed from respective rollers 13 and 15 to a flame lamination machine 19. Upon entering machine 19, a flame heats the layers so that they become sticky and nearly melt. Pinch rollers 17 in the machine then press the layers firmly together. Upstream from machine 19, a wire dispenser 21 deposits heating element wire 18 onto the upper surface of scrim layer 12. The dispenser moves reciprocally (in a direction into and out of the page) transversely across the scrim layer as it moves in the direction indicated by arrow 25 toward the lamination machine, thereby depositing the heating element in a serpentine pattern on the scrim. The element, sandwiched between the scrim layer and foam layer following rollers 17, is fixed between the layers by lamination machine 19. In another embodiment, the lower foam layer is added to the underside of scrim layer 12 by a second lamination machine downstream from machine 19.

Figure 2A:
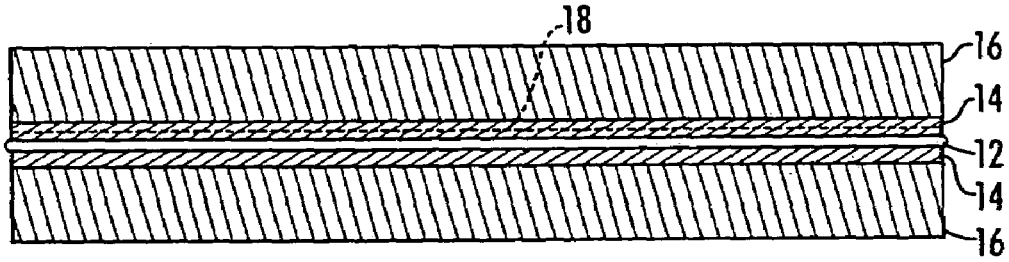
FIG. 2A illustrates a side cross-sectional view of a blanket according to an embodiment of the present invention.
Figure 2B:
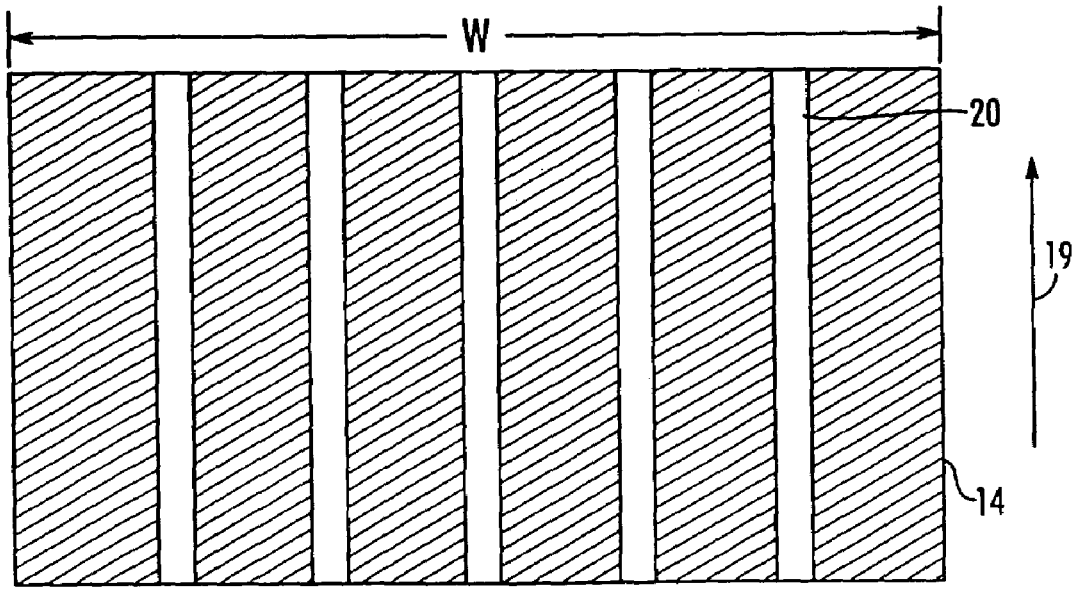
FIG. 2B illustrates a top cross-sectional view of the blanket as in FIG. 2A.

Referring to FIGS. 2A and 2B, another preferred electric blanket includes a heating element 18 disposed within parallel passageways 20 formed between scrim layer 12 and one of the foam layers 14. An electrical plug (such as described below with respect to FIG. 5) connects the heating element to an electrical power supply. Heating element 18 generates resistive heat responsive to the power supply.

The lamination process forms passageways 20 (FIG. 2B) between the scrim layer and one of the foam layers. As should be understood in this art, a lamination machine includes a series of flame jets extending across the width W of the blanket as the blanket passes below the jets in a direction indicated by arrow 19. To form passageways 20, flame jets are deactivated at positions corresponding to each passageway so that the lamination bond is not formed at these positions as the blanket moves in direction 19. Passageways may be formed in a direction transverse to that shown in FIG. 2B by periodically disabling the entire flame as the blanket passes through the lamination process. After forming the scrim/foam laminate, a flocking range adds oriented fiber layers 16 to each side of the laminate.

The blanket material is cut into sections, and a rod feeds the heating element through successive passageways in each blanket section. Any suitable tool or machine, for example as described below, may be used to run the heating element through the passageways. Bindings (not shown) sewn to the blanket ends cover the exposed heating element at the passageway openings. An electrical plug (not shown) connects the ends of the heating element to a power cord and a control circuit as described below.

FIG. 3 schematically illustrates an electric blanket having a heating element layer 22 disposed between a pair of scrim layers 12. Each scrim layer 12 is initially formed with a foam layer 14 laminated on only one side. After forming each scrim/foam laminate, a flocking range applies oriented fiber layers 16 to each foam layer. As described in more detail below with respect to FIG. 9, a wire dispenser disposed at the output of the lamination machine moves back and forth across the path of one of the laminate layers and deposits heating element wire on the layer's exposed scrim side. The two layers are then brought together so that wiring layer 22 is sandwiched between the two scrim layers, which are attached to each other by glue, heat seal, edge binding, or other suitable means, to form the blanket. In particular, adhesive or heat seal attachment holds the heating element in place between the scrim layers.

While the above examples include a scrim/foam construction, it should be understood that the present invention may include other suitable arrangements. For example, a wired scrim layer may be sandwiched between woven layers bonded to the scrim by adhesive or acrylic.

FIG. 4 illustrates one method of forming an electric blanket so that the heating element is woven into the blanket itself. A loom outputs a continuous sheet in which warp fibers run in three parallel longitudinal sections 22, 24 and 26. Outer sections 22 and 26 are non-conductive and may be formed from any suitable non-conductive fiber. These sections preferably contain flame resistant fibers or are coated with a flame resistant material before or after the weaving process. Conductive fibers, such as carbon black or conductive polymer fibers or metallic fibers, yarns or wires (hereinafter referred to as "conductive fibers," which should be understood to include all such materials), form middle warp section 24. Suitable conductive fiber materials are available under the trademarks METALLINE from Expan of Korea, GORIX from Gorix of Great Britain, and SEIREN from Seiren Company of Japan. Respective wires 28 run between conductive section 24 and each non-conductive section 22 and 26. Wires 28 are woven into the blanket and, in preferred embodiments, are metallic, carbon or polymer fibers of preferably 30–36 gauge. Each wire 28 may comprise a single conductive strand or may include multiple strands or fibers wrapped together.

The loom outputs weft fibers in three parallel transverse sections 30, 32 and 34. Sections 30 and 32 are non-conductive and may be formed from any suitable non-conductive fiber, such as used in warp sections 22 and 26. Conductive fibers, such as the fibers in section 24, form middle weft section 34. Respective sections 32 bound each middle section 34.

The loom outputs a continuous sheet having blanket segments separated by fringe layers 30 that contain little or no weft fibers and at which adjacent blanket segments are cut from each other. The dimensions of any of the warp or weft sections described above may be varied as desired for a given desired blanket size. It should therefore be understood that the illustration in FIG. 4 is not to scale and is provided for purposes of explanation only.

Due to the conductive and non-conductive weave described above, the interwoven conductive warp and weft fibers form a center weave section 36 composed entirely of conductive fibers. Side sections 38 and top and bottom sections 40 include conductive fibers in only one direction, while corner sections 42 include only non-conductive fibers. Accordingly, a voltage drop applied across wires 28 produces a wide area electrical distribution that heats center section 36, while sections 38 and 40, at which minimal current flow occurs, remain relatively unheated.

Figure 5:
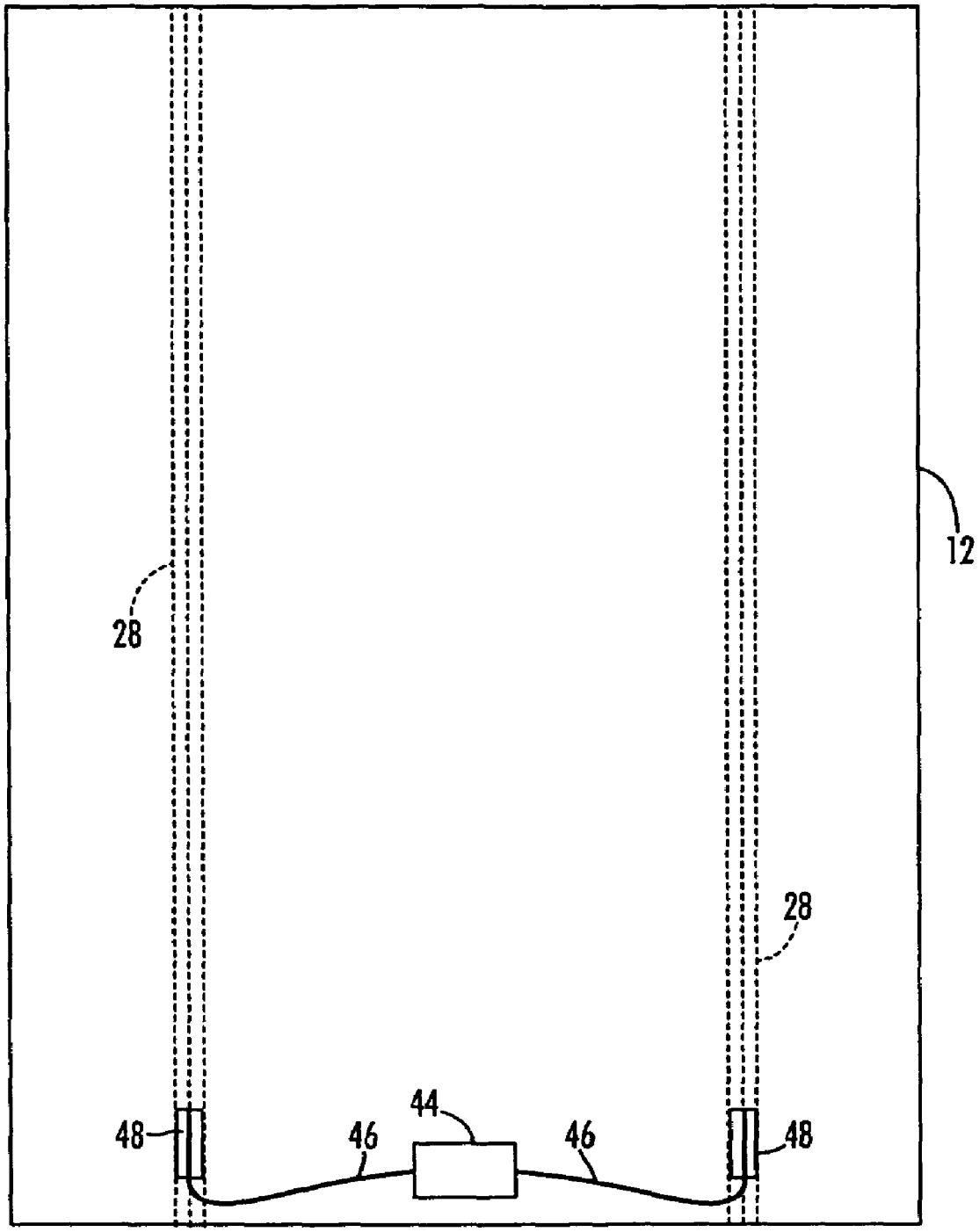
FIG. 5 illustrates a top view of a blanket according to an embodiment of the present invention.

Referring to FIG. 5, a power plug 44 applies electrical power to wires 28 and may attach through a conventional power cord to a battery pack or a wire and plug unit for attachment to an in-line power source wall receptacle. Lead wires 46 extend from power plug 44 and attach to respective wires 28 through a metal foil blank 48. Each foil blank 48 is sewn into blanket layer 12 or attached by other suitable means, for example ultrasonic welding. The blanket's side selvage areas are then folded over wires 28 and foil blanks 48. The bottom hem is folded over wires 46 and plug 44, and the two selvages and hems are sewn to form the blanket. A hole similar to a shirt button hole is cut in the lower hem at plug 44 for the plug's attachment to a power cord. Alternatively, and prior to attachment of the plug, foam layers may be laminated to either or both sides of layer 12, and oriented fibers may be attached to the foam layers. Following attachment of the plug and wires, the blanket hems enclose the conductor wires and plug.

As should be understood in this art, the plug is typically a custom made injection-molded device. The ends of wires 28 are stripped, and a crimping tool crimps a pair of wire attachments in a jig to the stripped wire ends. An injection molding machine molds a plastic casing about the male ends of the wire attachments so that the resulting plug can receive the power cord's female end.

Figure 6:
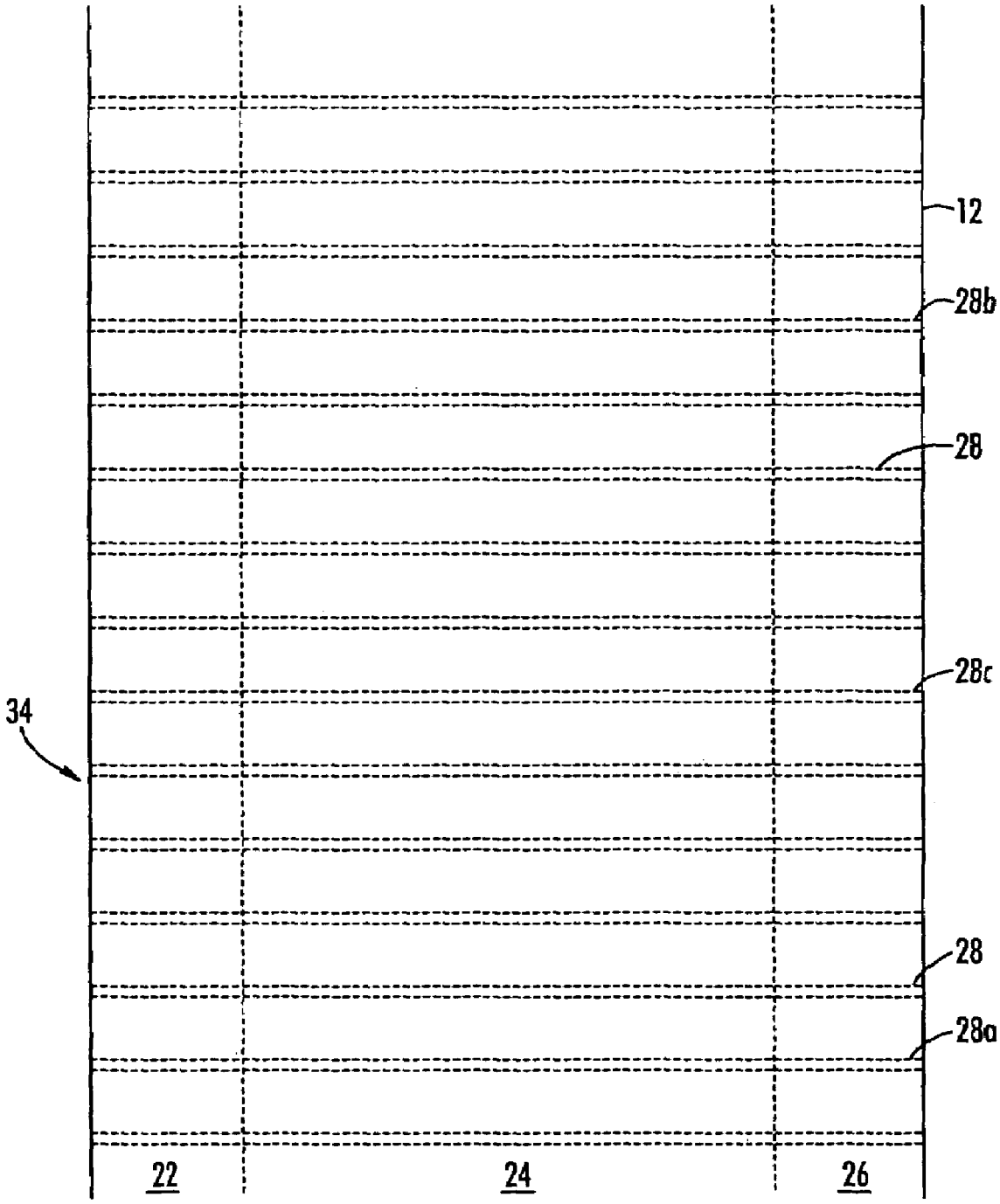
FIG. 6 illustrates a top cross-sectional view of a blanket according to an embodiment of the present invention.

The blanket-forming procedure described above utilizes a predetermined blanket size. Referring to FIG. 6, however, conductive blanket layer 12 may be formed in a roll so that a blanket may be later cut to a desired length. In this embodiment, layer 12 again contains warp fibers divided into conductive center section 24 and two non-conductive side sections 22 and 26. All weft fibers, however, are conductive fibers 34. Wire bundles 28 are disposed at a predetermined interval, for example every six inches, transversely across the layer. As should be understood in this art, looms are capable of inserting wires 28, and the particular weaving procedure is therefore not discussed in detail herein. Blankets of a desired length may be formed by making suitably spaced apart cuts across layer 12. While this results in multiple wires 28 across the blanket, a power plug may be connected through its lead wires as described above to the outermost pair of wires to thereby heat the entire blanket.

Figure 7:
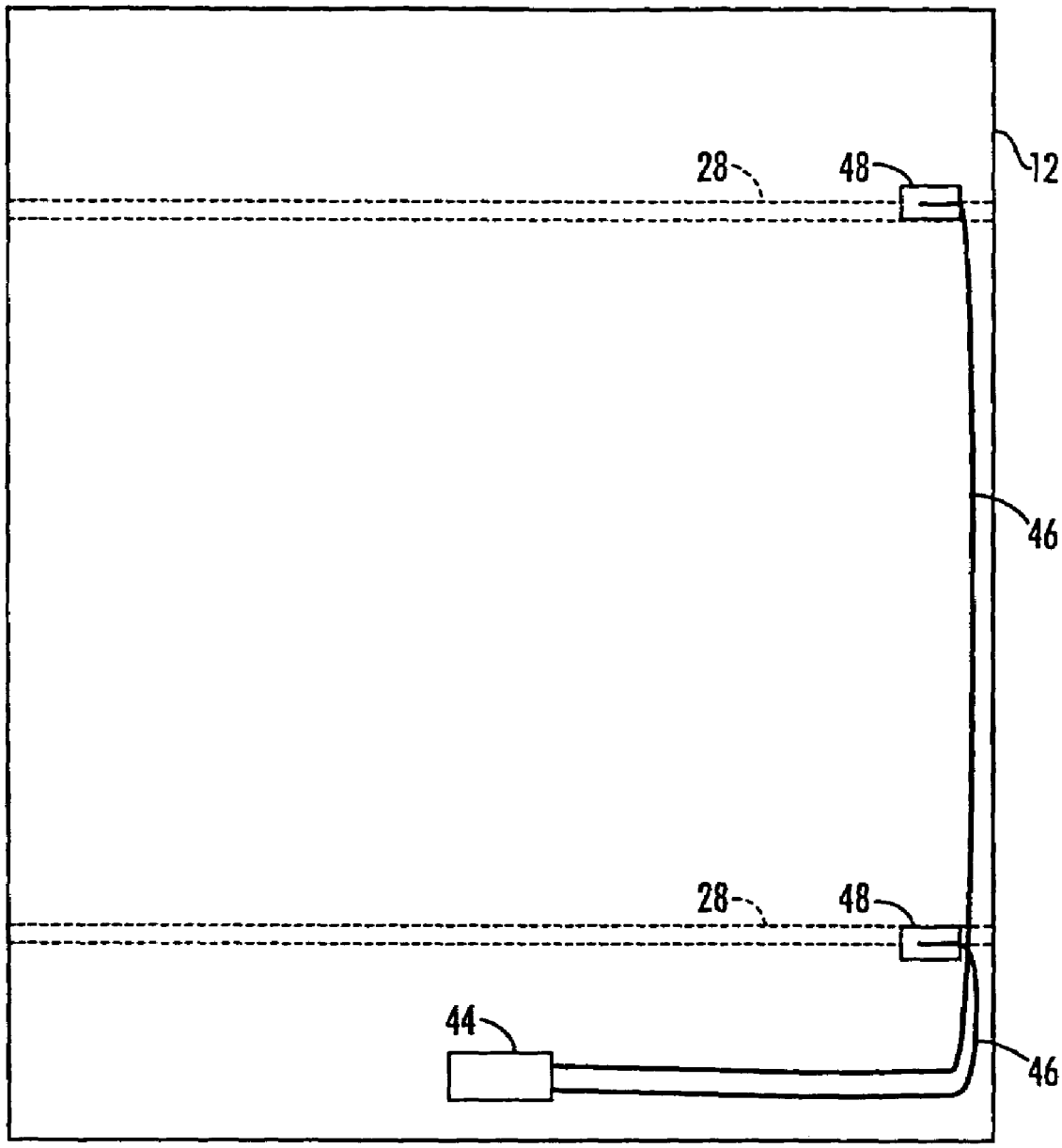
FIG. 7 illustrates a top view of a blanket according to an embodiment of the present invention.

To create a "zoned" blanket, in which different parts of the blanket may be independently controlled to desired heating levels, the blanket may include two sets of power plug/lead wires. For example, where a blanket is cut from conductive blanket layer 12 across the layer outward of wires 28*a* and 28*b*, a first power plug applied across wires 28*a* and 28*c* forms a first heating zone, and a second power plug applied across wires 28*b* and 28*c* defines a second heating zone. Thus, the left and right edges of the blanket sheet as shown in FIG. 6 define the blanket's top and bottom edges when it is used. Referring also to FIG. 7, a hemming area may be left on either side of the outermost wires 28 in which to dispose power plug 44 in a suitable manner. These selvage areas may also include additional wires 28 that are not used for power delivery. That is, wires 28*a* and 28*b* are the outermost conductor wires in the blanket, although they are not necessarily the outermost wires in the sheet used to make the blanket.

Figure 8:
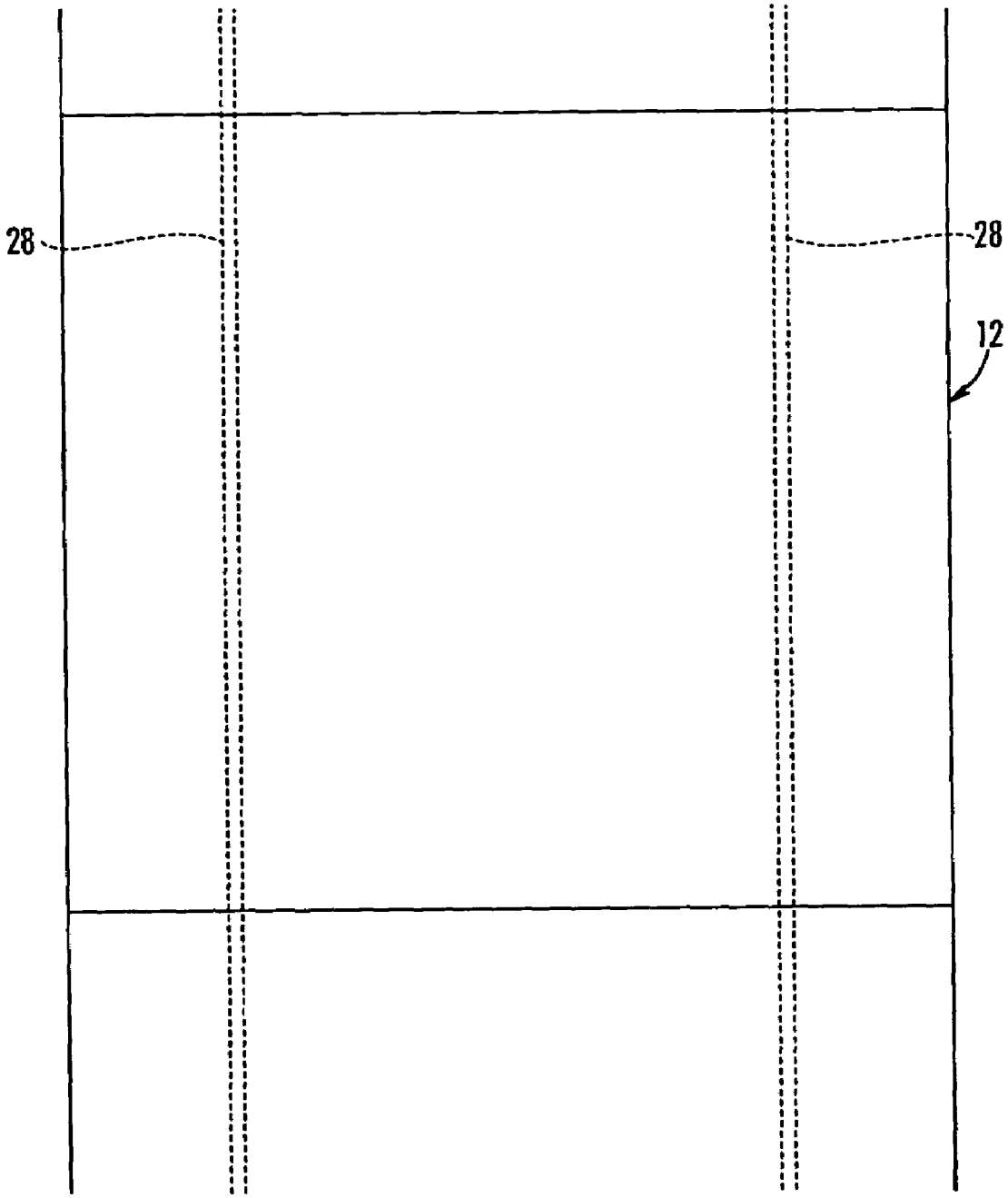
FIG. 8 illustrates a top cross-sectional view of a blanket according to an embodiment of the present invention.
Figure 11:
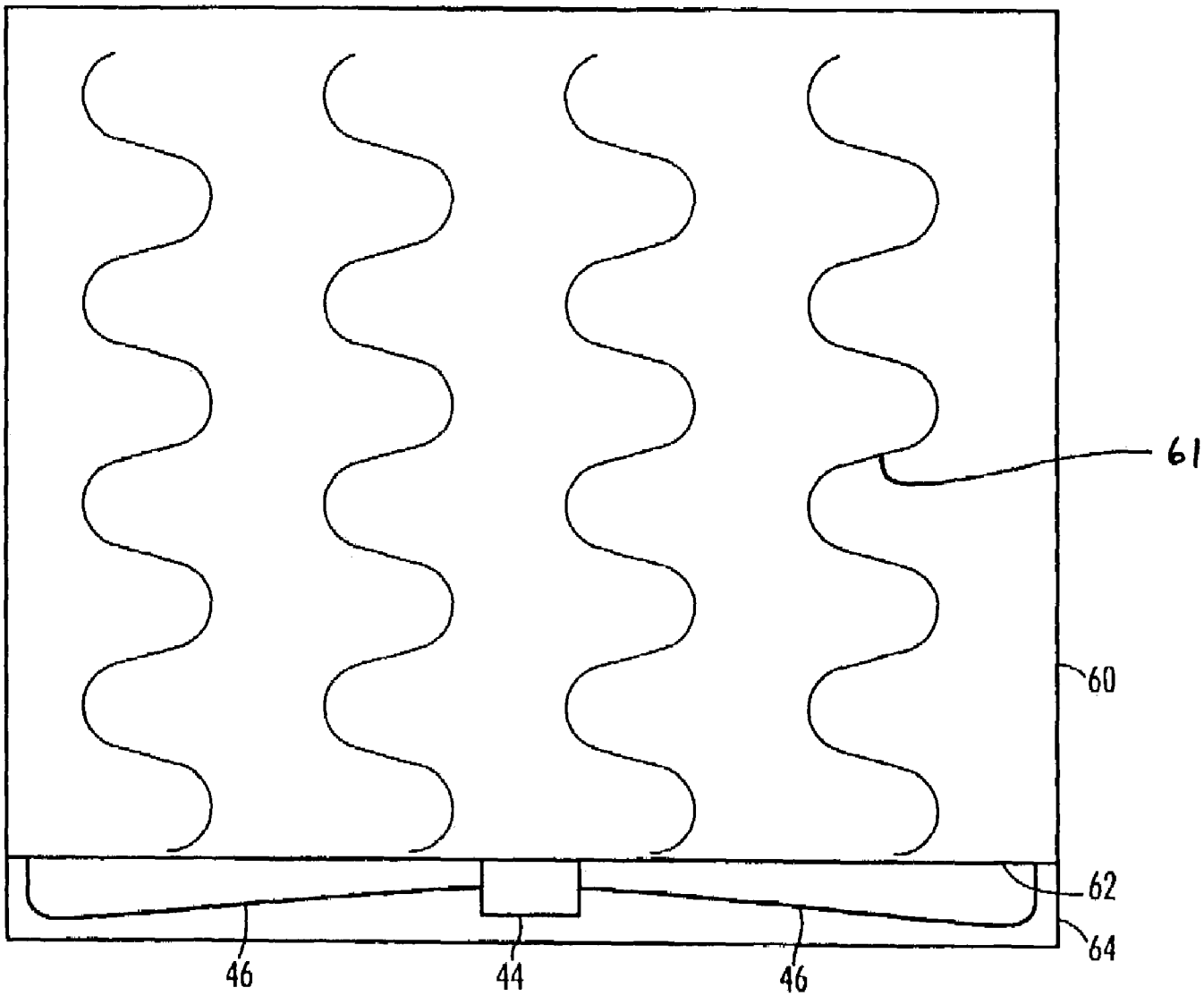
FIG. 11 illustrates a top cross-sectional view of a blanket according to an embodiment of the present invention.

Referring now to FIG. 8, the weft and warp fiber construction of scrim layer 12 is the same as described above with respect to FIG. 6. This embodiment, however, only uses two wire bundles 28, each running longitudinally with the warp as in the embodiment discussed above with respect to FIG. 4. As in the previous embodiment, a blanket may be formed by cutting blanket layer 12 to any desired length. After cutting the layer and forming the blanket, the power plug and lead wires are disposed as shown in FIG. 11, and the power plug is folded or sewn into the hem. Accordingly, the left and right edges of the blanket sheet as shown in FIG. 8 define the blanket's top and bottom edges when it is used. Control circuitry (discussed below) for controlling application of power to the heating element is external of the power plug and is disposed in-line with a power cord extending between a power source, for example batteries or an AC wall power source, and the power plug.

Figure 9:
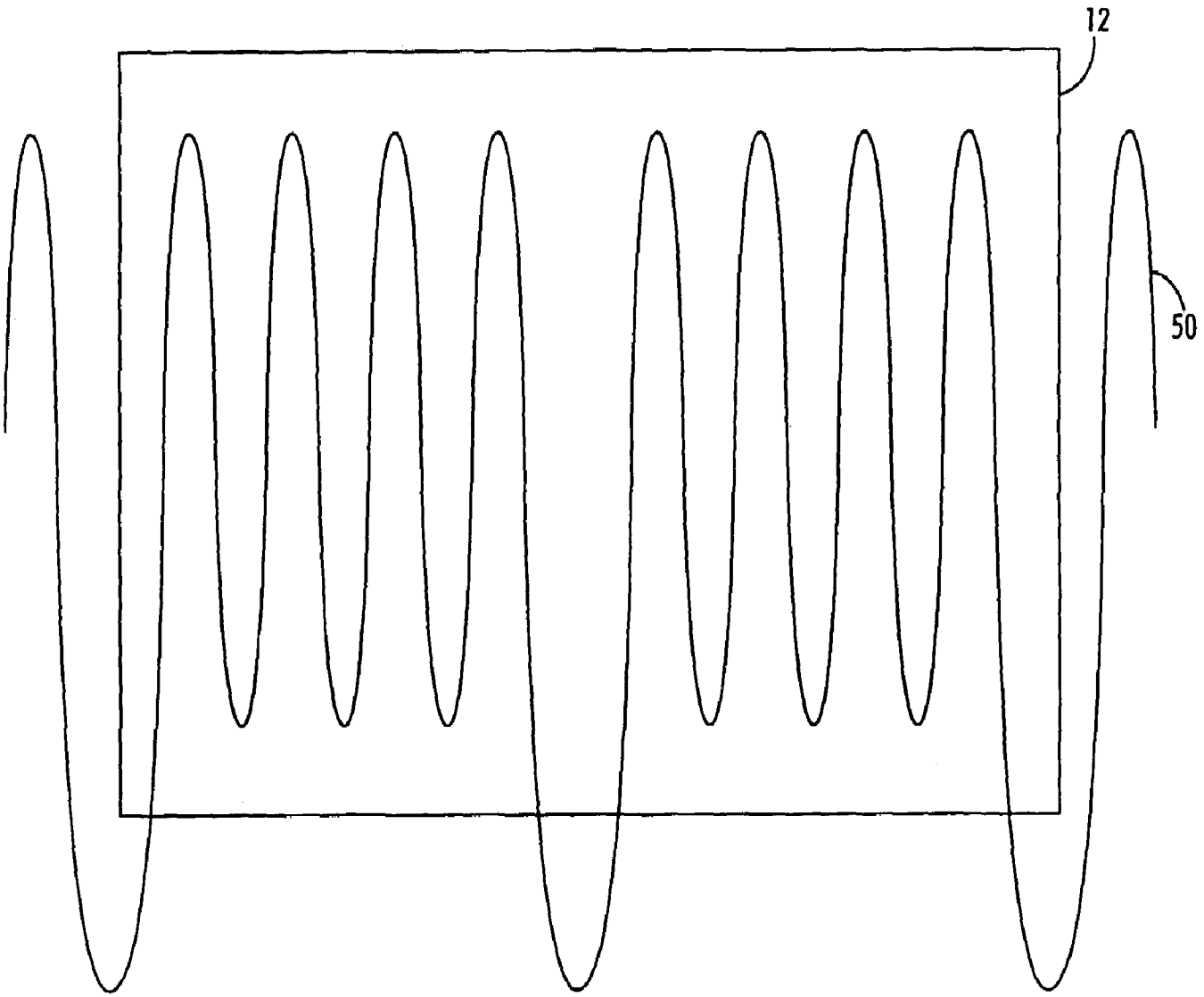
FIG. 9 illustrates a top cross sectional view of a heating element disposed in a blanket according to an embodiment of the present invention.

Such power plug/control circuit/lead wire arrangements may also be used with the earlier-described blankets in which a wire heating element is disposed on or in an otherwise non-conductive scrim layer. Referring to FIG. 9, for example, an oscillating dispenser (not shown) deposits a heating element 50 in a serpentine path on scrim layer 12. Periodically, the dispenser loops the wire into and beyond the selvage area to enable the wire's connection to the lead wires of a power plug. If a blanket includes only one heating zone, the dispenser loops the heating element into the selvage area only at the blanket segment edges. For a dual-zone blanket, the dispenser also loops the wire the middle of the blanket segment.

As described above, the feeder may deposit wire 50 onto the scrim layer before or after lamination of the foam layers onto the scrim. The scrim and foam layers are then laminated together, securing the wire in place between the two layers. In another embodiment, however, foam layers are laminated to respective scrim layers before application of the heating element. A wire feeder disposed at the output of the lamination machine deposits the element on one of the two scrim layers, which is then adhered to the other scrim/foam pair so that the heating element is sandwiched between the two scrim layers. In either embodiment, the blanket, which may also include flocked layers of oriented fibers as discussed above, may be formed in a continuous roll and cut into individual sections. In each section, a hem receives the power plug and lead lines. More specifically, the wire loops are cut, power plugs are attached across the cut element ends by lead wires as discussed above, and the plug/lead wires are hemmed into the blanket edges. A hole is cut in the hem to provide access to the plug, and the hole edges are stitched to prevent fraying.

Figure 10:
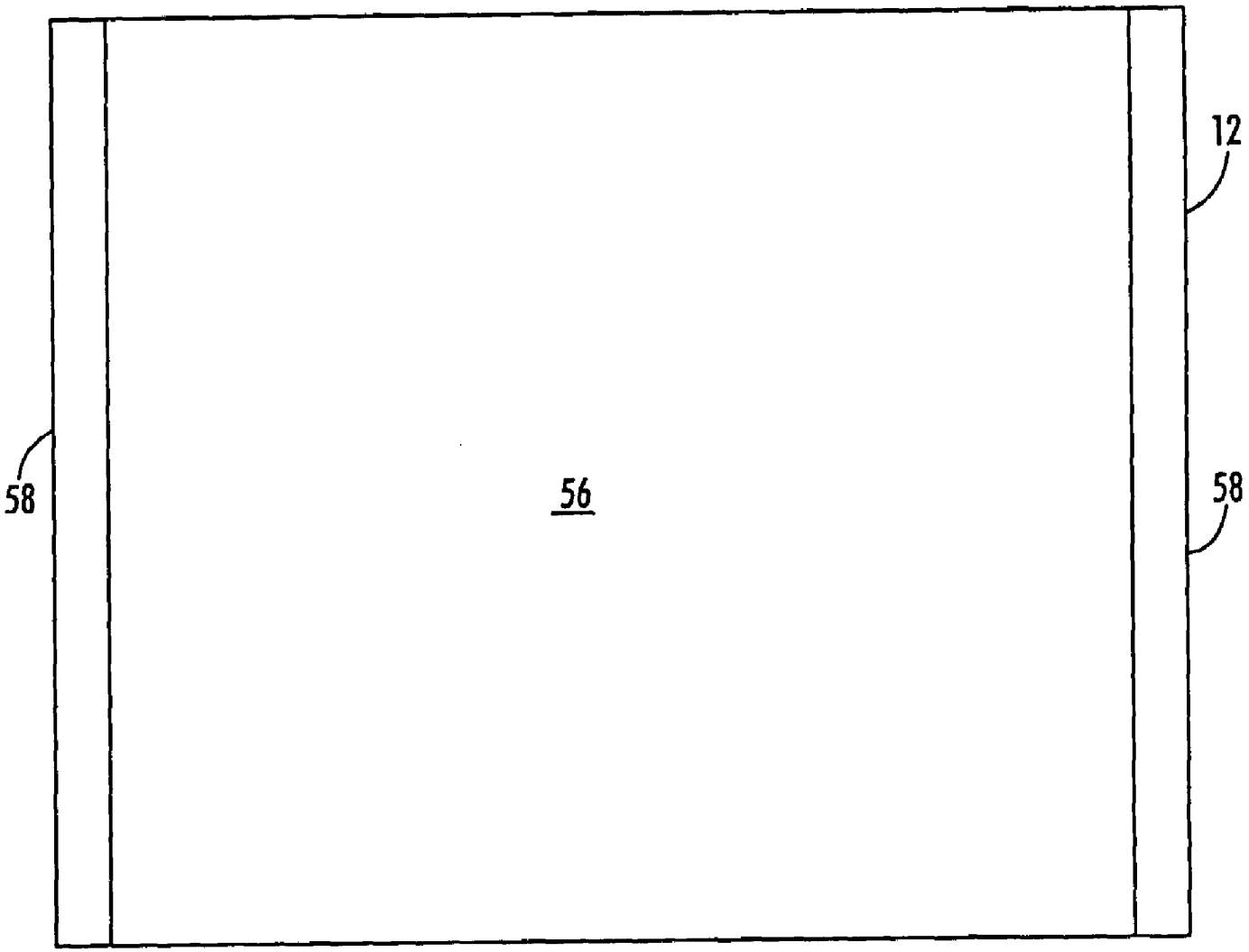
FIG. 10 illustrates a top view of a blanket according to an embodiment of the present invention.
Figure 21:
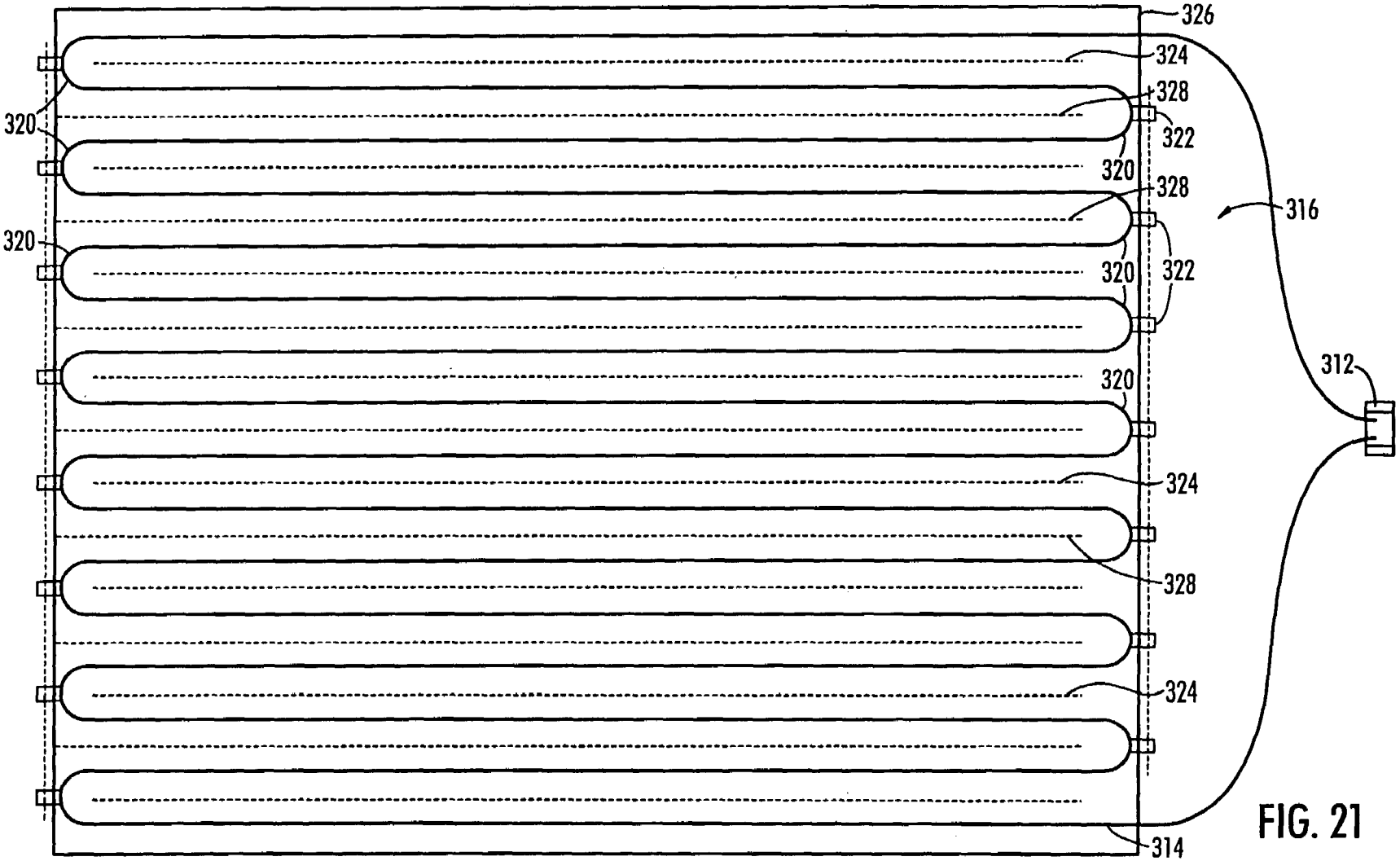
FIG. 21 is a front elevation view of an assembled heating element for use with an electric blanket according to an embodiment of the present invention.

Wired scrim layers as described with respect to FIGS. 2, 3, and 21 (preferably without laminated foam layers and with the heating element attached to the scrim by adhesive or other suitable means)and conductive blanket layers as shown in FIG. 4, may be used to form an electric quilt. The particular arrangement of the heated layer may vary as desired, and it should be understood that the heating element may be disposed on any foundation on which the heating element is accessible to connection to a power source and protected against short circuit and which can be inserted into a quilt cover. Thus, FIG. 10 illustrates a blanket layer 12 defining a heated center section 56 comprising, for example, a wire layer disposed on a foundation layer or a weave of conductive fibers. The wires or fibers extend into selvage areas 58, which carry wire bundles for connection of area 56 to a power source.

FIG. 11 illustrates a comforter bag 60 made in any conventional manner. The bag includes top and bottom sides sewn on three edges so that the bag opens at the fourth edge. The bag receives layer 12 (FIG. 10), along with any suitable batting, through the open edge 62. Preferably, the batting is inserted first. As should be understood in this art, batting may comprise any suitable filler material, for example a web of soft bulky, usually carded, fibers. In one preferred embodiment, the batting is cut from a continuous non-woven polyester sheet.

The heating element, on a scrim or other substrate or as part of a conductive weave, is inserted on top of the batting. Alternatively, an unattached heating element wire may be pushed into the quilt by a tool having one or more elongated fingers that push the heating element into the quilt bag, leaving the heating element in successive loops on the batting when the tool is removed. The batting and scrim are both preferably non-flammable or self-extinguishing. Lead wires 46 are attached to the heating element through open edge 62, and wires 46 and power plug 44 are folded or sewn into the quilt by a selvage section 64 as open edge 62 is closed. The bag is then flipped over, so that the heating element is below the batting, and a quilt pattern 61 is sewn through the quilt. A mechanical or electrical attachment skips the sewing head over the heating element in the quilt.

Figure 23:
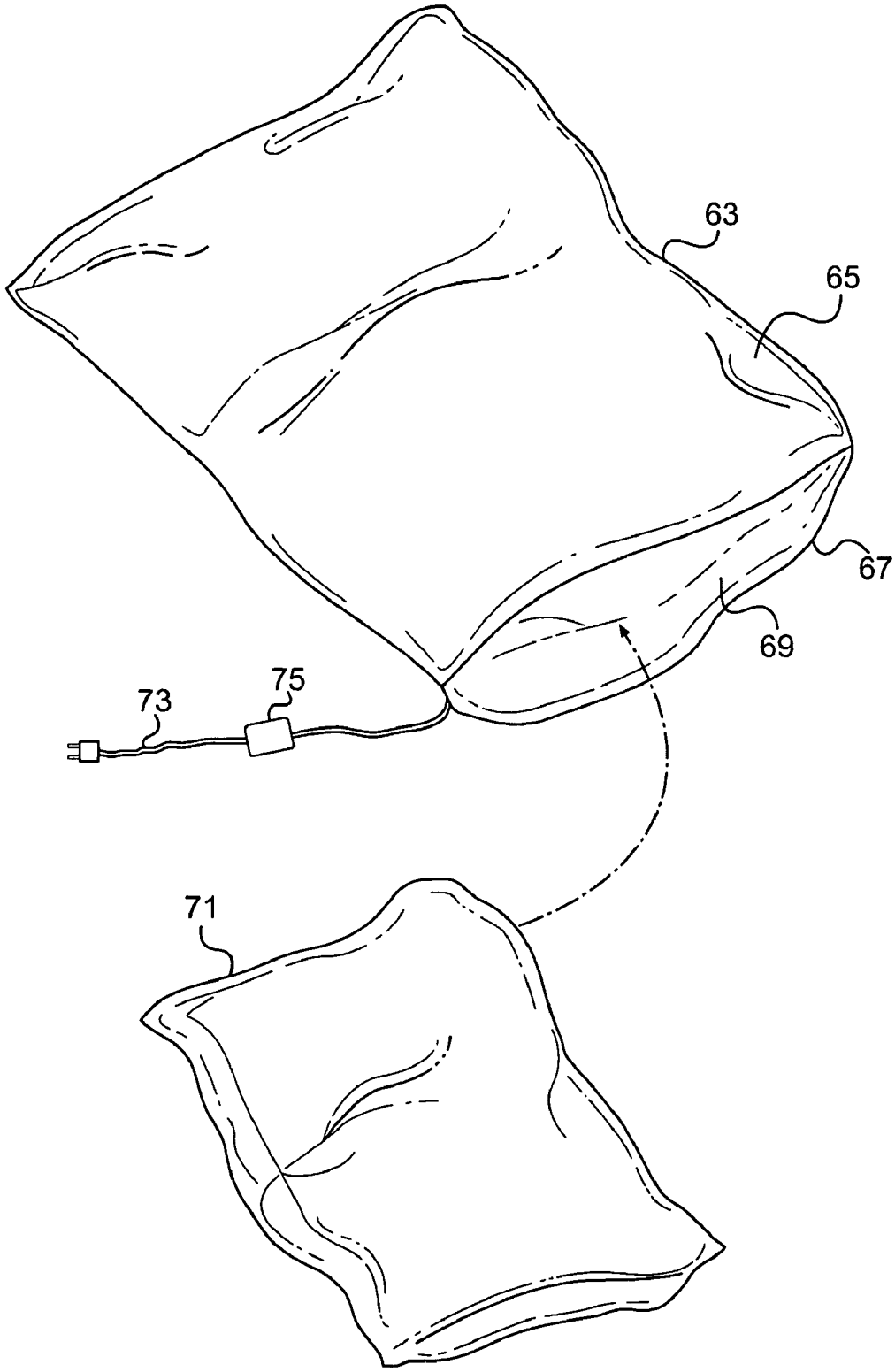
FIG. 23 is a schematic illustration of a quilt in accordance with an embodiment of the present invention.

A quilt may also be formed by sewing a non-heated blanket layer, made from a weave, a scrim-based blanket or any desired blanket material, to a heated blanket along three of the blankets layers' edges, thereby forming a bag with an open edge Referring to FIG. 23, a bag 63 includes a non-heated top layer 65 and a heated bottom layer 67 sewn together along three sides so that they define an open edge 69 through which a batting sheet 71 is inserted as discussed above. The fourth edge is then sewn, and a quilt pattern is sewn through the quilt. Heated layer 67 may comprise an electric blanket, for example a conventional prior art electric blanket, which should be understood by those skilled in the art, or blankets formed in the manners discussed herein, having a power cord 73 extending therefrom for connections to a power source and having control circuitry (such as described below) housed in a control box 75 in-line with the power cord.

Figure 12:
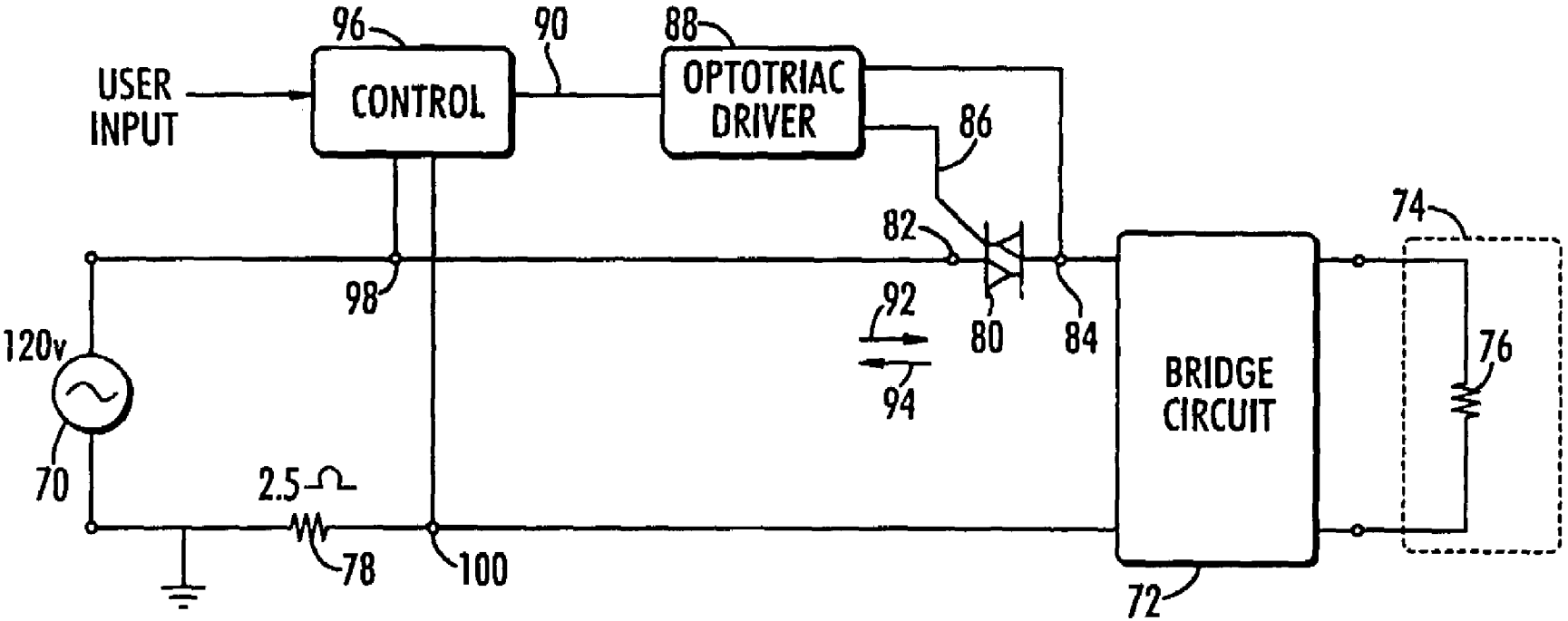
FIG. 12 illustrates a side cross-sectional view of a blanket according to an embodiment of the present invention.

FIG. 12 shows a schematic illustration of a control circuit for use with an electric blanket, indicated in phantom at 74. The control circuit manages the heating element's temperature and detects shorts, opens and partial shorts in the heating element. The heating element is incorporated in the blanket in a conventional manner or in any of the arrangements described above and is indicated at 76 as a resistance. The resistance may represent a heating element in any suitable heated, generally planar spread, such as a blanket, quilt (e.g. as discussed above), mattress pads and heating pads, and the term "electric blanket" as used herein with respect to the control circuit should be understood to include all such spreads.

A 120 volt AC voltage source 70 powers the heating element through a full-wave bridge rectifier 72, a sampling resistor 78 and a triac switch 80. As should be understood by those skilled in this art, a triac switch conducts AC current between inputs 82 and 84 in both directions as long as an activating signal is present on a control lead 86. If the activating signal is discontinued, the triac conducts current until the input signal's next zero crossing.

The activating signal is provided by an optically isolated triac driver 88 that acts as a switch passing current from node 84 to the control lead 90. Thus, when driver 88 is activated by its control lead 90, the signal from source 70 drives triac 80. During this signal's positive cycle portion, current travels through triac 80 in the direction indicated by arrow 92. During its negative cycle position, current travels through the triac in direction 94.

A control circuit 96 controls driver 88. Control circuit 96, for example comprising a single integrated circuit (IC), may include a microprocessor and an A/D converter. Through the converter, the IC receives voltage measurements from nodes 98 and 100. The measurement from node 100 is the voltage across sampling resistor 78. Thus, the controller may determine the current through heating element 76 by dividing the voltage measured at 100 by the known resistance of sampling resistor 78. The voltage applied to the system is measured at 98. Thus, the system's total resistance is equal to the voltage measured at 98 divided by the current measured at 100. The resistance of heating element 76 may therefore be determined by backing out the known resistances of the components upstream from the heating element.

As discussed above, the temperature of heating element 76 is related to its resistance. Wire manufacturers typically rate wire resistance with respect to a predetermined temperature, generally around 75° Fahrenheit. The manufacturer also typically provides the wire's temperature coefficient. Thus, given a known length L of heating element 76 having a temperature coefficient TC and a rated resistance X (in ohms per unit length) at Y° Fahrenheit, and given a measured resistance Z (in ohms) between nodes 98 and 100 as discussed above, heating element temperature $T=Y+(1/XL)(Z-XL)/TC$.

The variables Y, TC, X and L are known and may be stored in memory associated with control circuit 96. Therefore, upon determining the measured resistance Z, the control circuit may determine the heating element's temperature T by the equation above. Alternatively, temperature T may be calculated over a range of resistances Z to create a table relating temperature to measured resistance. The table may then be stored in the control circuit's memory so that the control circuit, upon determining an actual measured resistance between nodes 98 and 100, may determine temperature T by reference to the table.

The control circuit 96 may be disposed in a suitable housing attached to or within blanket 74, for example in-line with a power cord between the power source and the heating element in the examples discussed above with respect to FIGS. 1–11 and 23. The control circuit may be configured for use with several different heating elements, whether of a wire, woven fiber or other suitable type, each having a range of possible measured resistances Z that does not overlap the range of any of the other heating elements. Thus, the measured resistance Z identifies which heating element the blanket contains, and the control circuit can then determine temperature T from the temperature coefficient TC and nominal temperature Y for that heating element or from a lookup table for that heating element.

Control circuit 96 manages the heating element temperature by various methods. Generally, however, the heating element's heat output varies predictably with current. Since triac 26 controls the amount of current passing through the heating element, the element's heat output may be determined by controlling the ratio of the triac's on-time to its off-time based on some predetermined scale. Various control methods are described in Applicant's U.S. Pat. No. 6,222,162, the entire disclosure of which is incorporated by reference herein.

In normal operation, control circuit 96, driven by its microprocessor, may manage blanket temperature to a target temperature in a direct relationship to the heating element's measured resistance. Since a rise in measured resistance, and a drop in measured current, reflects a rise in temperature, the control circuit generally reduces current flow to the blanket responsively to a resistance increase, or current decrease, reflecting that the blanket's temperature is rising beyond the target temperature. Similarly, the control circuit reduces current flow to the heating element responsively to a measured resistance decrease, or current increase, reflecting that the blanket's temperature is falling beyond the target temperature.

The control circuit also responds, however, to conditions in which the normal relationships of current and resistance to temperature don't hold, such as opens, drastic shorts and partial shorts in the heating element. For example, while shorts may result in temperature increases, they also exhibit resistance decreases and current increases. A "drastic" short is a short circuit over a major portion of the heating element that causes a current increase significantly beyond a safe operating range. Accordingly, the control circuit stores a threshold resistance value that reflects the occurrence of a drastic short, and the control circuit disconnects the blanket's power when the measured resistance falls below this threshold. The particular threshold value depends on the heating element's characteristics, as should be understood by those skilled in the art. In a blanket having a typical heating element resistance of 100Ω, however, the control circuit disconnects power upon detecting a resistance of 80Ω or less.

Similarly, in another preferred embodiment, the control circuit disconnects the blanket's power when the current measured at 100 rises above a predetermined level. In a blanket having a typical current level of 1.1 amps, for example, control circuit disconnects power upon detecting a current level of 1.25 amps or more.

Heating elements are relatively long, and they may therefore be subject to "partial" shorts—short circuits across a limited portion of the element that produce a current increase relatively smaller than that of a drastic short. In particular, partial shorts may increase current to within a range experienced normally when the blanket is cold. The control circuit detects partial shorts, and differentiates them from a normal cold condition, based on the rate of change in the element's resistance or current. When the element's resistance or current changes due to acceptable temperature fluctuation, the change takes a relatively long time. For example, wire made from 34 gauge cadmium copper alloy takes thirty seconds or longer to change from 45° C. to 49° C., corresponding to a resistance change from 176.2Ω to 178.8Ω and a current change of 0.624 amps to 0.615 amps. Thus, assuming that this temperature change is acceptable, the control circuit should not interpret a 2.6Ω or a 0.007 amp change over a thirty second period to indicate a partial short. The circuit does recognize a partial short, however, if such a resistance or current change occurs within a period less than that acceptable for normal temperature fluctuations. The definition of this time period depends on operational factors such as the heating element's materials and dimensions. In one embodiment, for example, where a heating element is a 34 gauge cadmium copper alloy wire, the control circuit disconnects power to the heating element if there is a 0.5Ω resistance decrease or 0.002 amp current increase, or greater, from one current cycle to the next. Of course, other arrangements may be suitable under different circumstances. PTC wire, for example, has a relatively high temperature coefficient, and it's resistance may change relatively quickly without being subject to a short. In this instance, the control circuit may be configured to disconnect heating element power if the processor detects a cycle-to-cycle resistance change of 2Ω or more or a current change of 0.025 amps or more.

The control circuit also disconnects heating element power if it detects an open in the heating element. In a preferred embodiment, the control circuit disconnects power if it senses that the heating element's resistance is at or above, or if the current level is at or below, a threshold level that is sufficient to indicate an open has occurred. The particular threshold value for a particular heating element will depend on the element's characteristics. In one example, however, in which the heating element normally exhibits a 100Ω resistance and 1.1 amp current, the control circuit disconnects heating element power upon detecting a resistance of 200Ω or greater or a current of 0.55 amps or lower.

Accordingly, a measured resistance or current outside ranges that would be expected during normal operation may indicate an open or a partial or drastic short, and the control circuitry disconnects electricity flow to the heating element. Abrupt up or down resistance or current changes may also indicate these conditions, and the control circuitry therefore also disconnects power responsively to the rate at which these parameters change.

FIGS. 13 through 21 describe and illustrate the use of a machine for inserting a heating element into a blanket having parallel passageways to receive the element. Upon loading a blanket shell at a loading station, the machine propels a single heating element strand through the shell's passageways. The blanket shell material may be pre-formed to have two layers of fabric secured together along ending lines to provide parallel coextensive passageways between the material layers. It should be understood, however, that any suitable technique, for example those discussed above, may be used to form the passageways.

Figure 13:
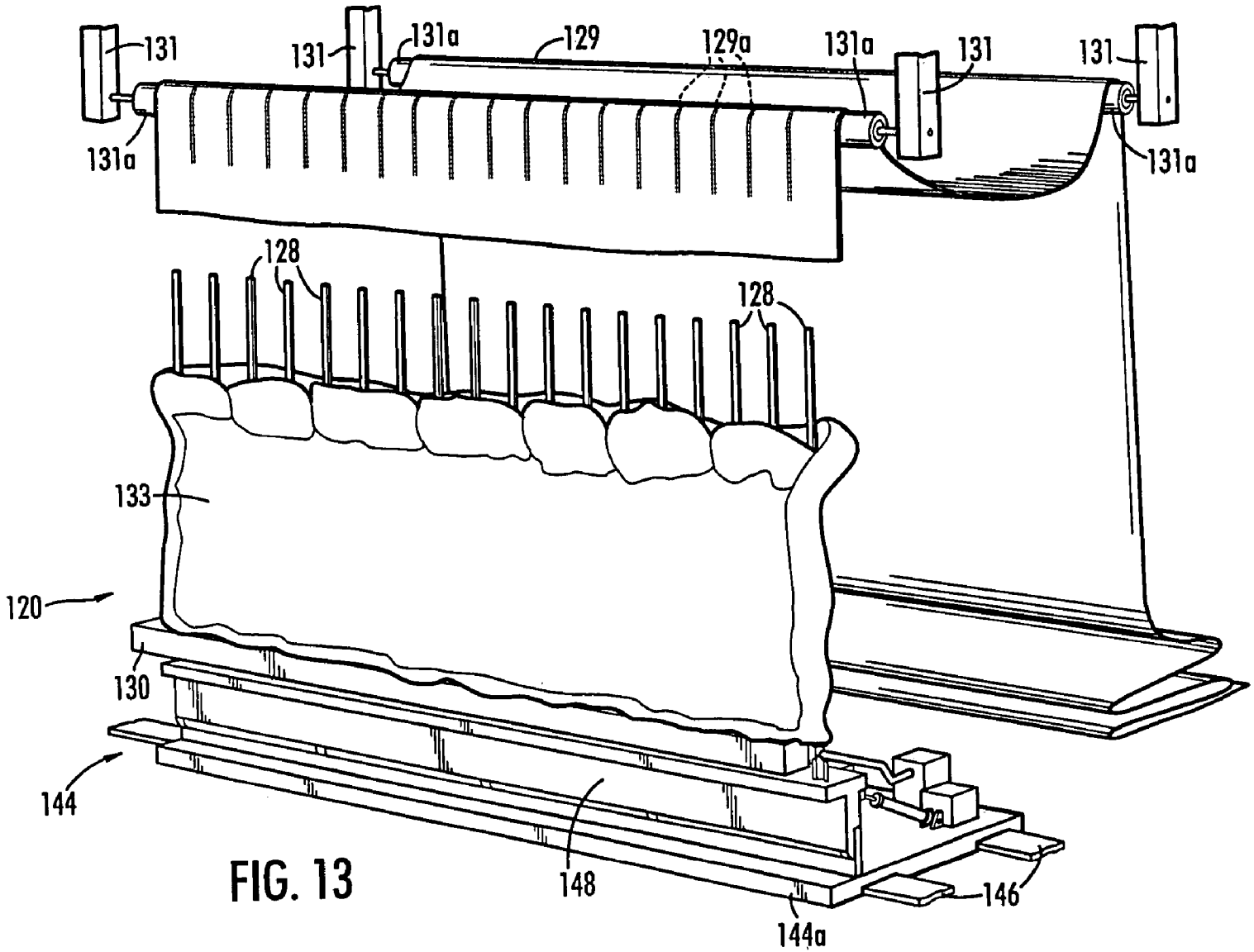
FIG. 13 is a partial perspective view of a blanket wire insertion machine according to an embodiment of the present invention.

Referring to FIG. 13, a heating element insertion machine 120 (shown partially in FIG. 13) includes a plurality of guide tubes 128 onto which a blanket shell 133 is initially loaded so that guide tubes 128 extend through each adjacent passageway. A continuous supply of blanket shell 129 is drawn over a frame 131, which includes rollers 131*a* that supply the blanket shell material from directly above guide tubes 128. After threading enough shell material onto the guide tubes for a single blanket shell 133, the operator cuts the material transversely at the top of guide tubes 128 along a pre-marked line and then rumples shell 133 down over the tubes.

Figure 14:
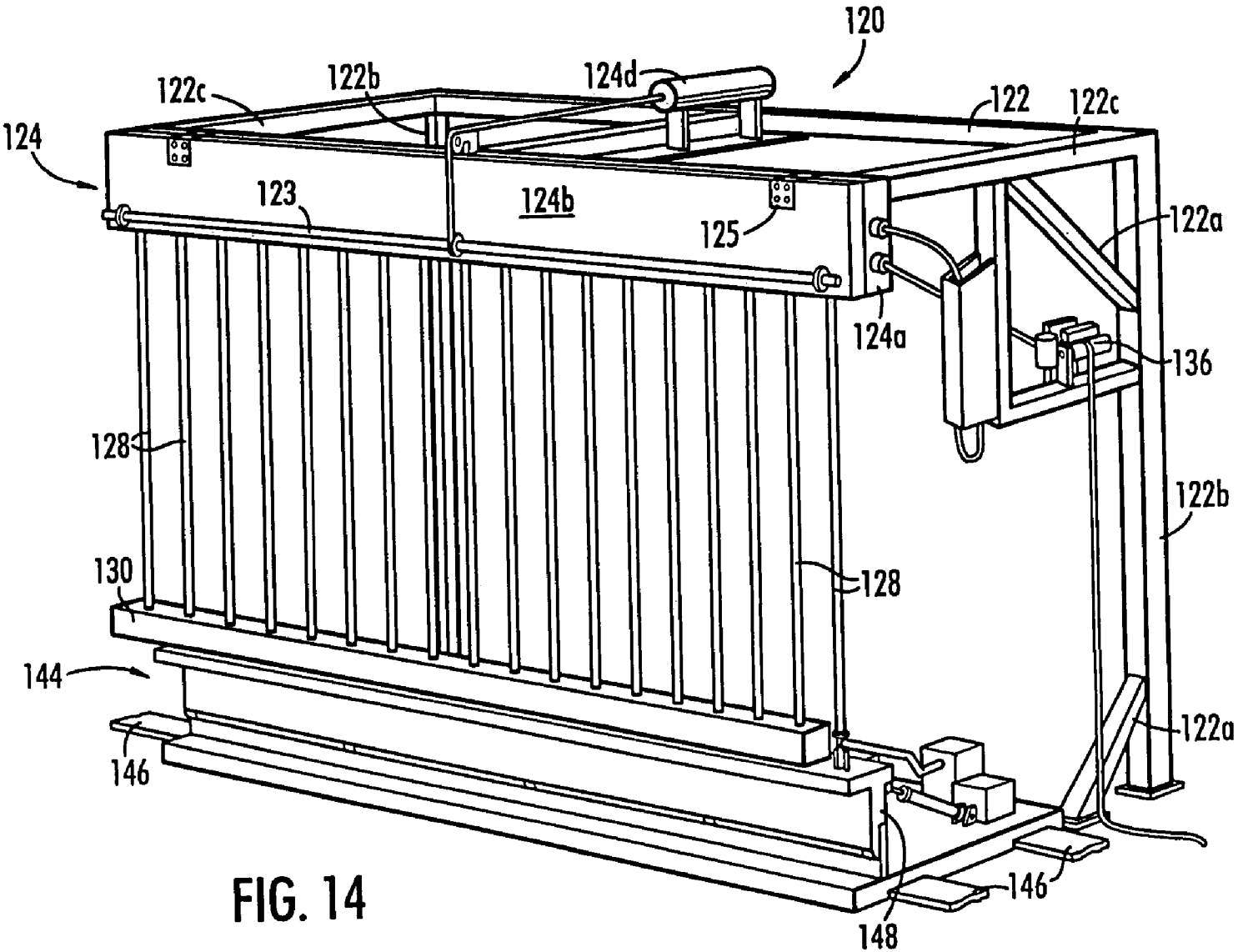
FIG. 14 is a perspective view of the machine of FIG. 13 showing the guide tubes and other portions of the machine in the operating position.
Figure 15:
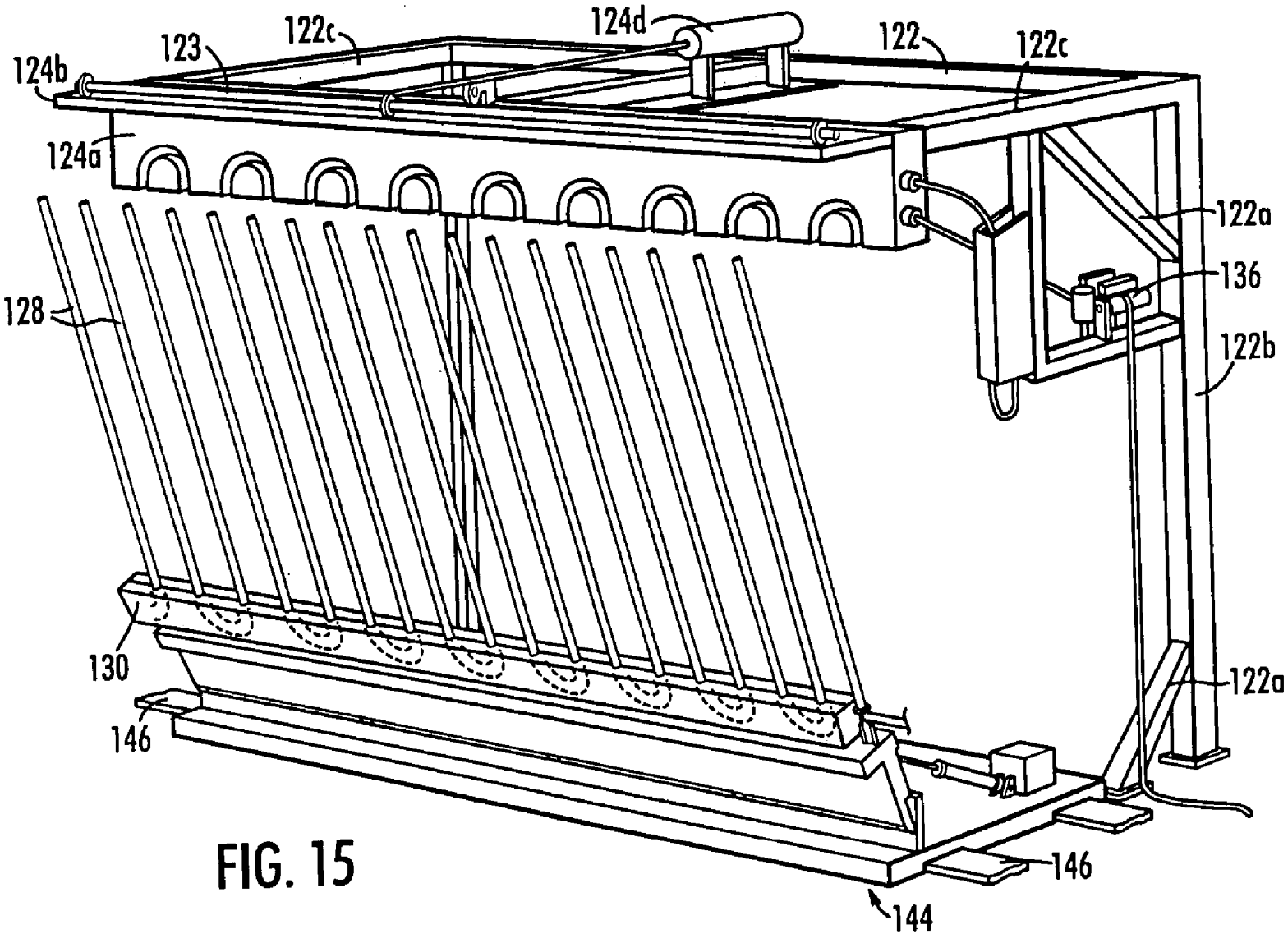
FIG. 15 is a perspective view of the blanket wire machine showing the guide tubes in their unload position.
Figure 16:
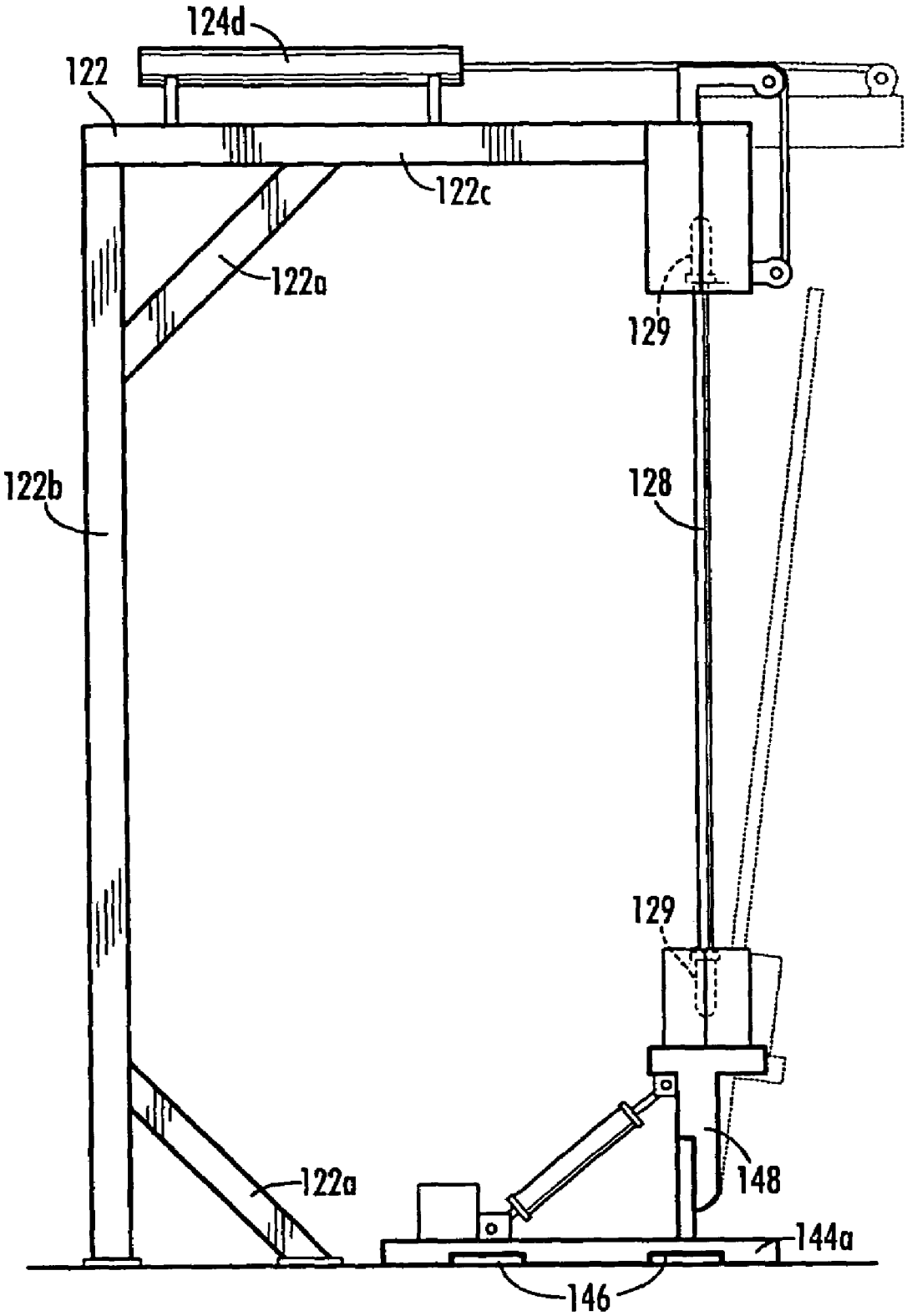
FIG. 16 is a side elevation view of the blanket wire insertion machine and showing the guide tubes in their operating position in solid lines and in dotted lines for the load/unload

For purposes of clarity in illustrating the blanket loading procedure, FIG. 13 omits a frame 122 (FIGS. 14–16) that also forms part of machine 120. Frame 122 would interfere with frame 131 if frame 131 were aligned directly above tubes 128 and frame 122 in their operative position. Accordingly, frame 131 is disposed to one side of frame 122, and machine 120 therefore includes a mechanism to move the tubes away from frame 122 into a loading position as shown in FIG. 13. Referring to FIGS. 13–16, a movable carriage 144 carries guide tubes 128 and a tube support 130. A pair of guide rails 146 slidably receives carriage 144 for transverse, horizontal movement with respect to frame 122. Guide rails 146 extend transversely to the right and left of frame 122 a sufficient distance so that carriage 144 may be moved in either direction completely beyond frame 122 to loading positions, one of which is shown in FIG. 13, at which a frame 131 is located. After a blanket shell is placed over guide tubes 128 at the loading position and the shell is cut to form the single shell, carriage 144 moves to a central insertion station in front of frame 122 as shown in FIGS. 14–16. It should be understood by those skilled in the art that the carriage may be manually or automatically moved on the guide rails.

Carriage 144 includes a base plate 144*a* having a pair of slots that receive the guide rails. A platform 148 has a first end pivotally attached to the base plate and a second end attached to support 130. A pneumatic piston is attached between platform 148 and the base plate. A lever (not shown) attached to platform 148 allows a user to pivot the platform and tubes between the positions shown in FIG. 16.

Frame 122 is generally box-like and has a plurality of vertically extending posts 122*b*, supports 122*a* and a plurality of horizontally extending braces 122*c* that combine to form the frame from which the various elements of the machine 120 are supported. A guide wall 124 at the upper front portion of frame 122 includes a rear guide wall 124*a* and a pivotally supported closure wall 124*b*. Hinges 125 pivotally connect the upper edge of closure wall 124*b* to rear guide wall 124*a*. Springs on hinges 125 urge closure of closure wall 124*b* to the position as seen in FIG. 14.

In front of frame 120, guide tubes 128 are positioned between guide wall 124 and support 130 in a generally vertical position and are adapted to be tilted forwardly from the vertical position as shown in FIG. 14 to the somewhat inclined position shown in FIG. 15. A pneumatic piston 124*d* pivots wall 124*b* between the positions shown in FIGS. 14 and 15, which define the operating and the load/unload positions, respectively. Suitable controls, for example including a microprocessor, for automatically controlling piston 124*d* should be understood by those skilled in the art and are, therefore, not discussed in detail herein. A handle 123 extending horizontally across the front of the wall 124*b* permits the machine operator to pivot the wall 124*b* manually when necessary.

Referring to FIG. 17, guide tubes 128 are elongated, each having a lengthwise extending passageway 28*a* therethrough in fluid communication with each other via upper and lower manifolds 129. Guide wall 124 defines upper manifold 129, while support 130 defines lower manifold 129. Both upper and lower manifolds provide fluid communication between pairs of adjacent guide tubes to form a continuous path through tubes. Both upper and lower manifolds 129 are split to allow release of the heating element. Preferably, the manifolds contain a gasket positioned where the manifold halves abut each other to prevent undesirable air leakage within the manifolds. O-rings may be provided about the ends of the tubes where the tubes contact the manifold.

Figure 19A:
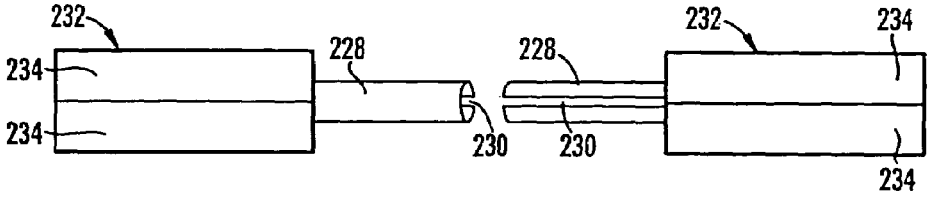
FIG. 19*a* is a front elevation view of a blanket wire insertion machine with the guide tubes in a horizontal orientation according to an embodiment of the present invention.
Figure 19B:
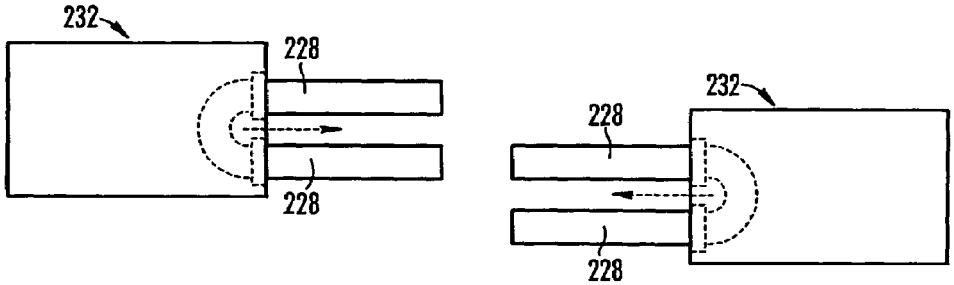
FIG. 19*b* is a top elevation view of a blanket wire insertion machine with the guide tubes orientation horizontally according to an embodiment of the present invention.

FIGS. 19*a* and 19*b* show an alternative embodiment in which guide tubes 228 are horizontally oriented. Tubes 228 extend through the blanket's passageways in a manner similar to the vertically oriented tubes. Each horizontal tube, however, is comprised of two interlocking halves that extend toward each other from opposing side manifolds. To load or unload a blanket shell onto the tubes, the manifolds and tube halves are pulled apart from each other, and the blanket shell is put on or removed from one set of tube halves or the other. The manifolds are then brought back together in their interlocking position. It should be understood that the manifolds may be disposed so that the guide tubes in this embodiment are vertical.

Tubes 228 have interior slots 230 that allow release of the heating element once it has threaded through the blanket. Each side manifold has a split construction with a pair of pivotally connected manifold halves 234. Once the heating element is looped through all the tubes and the manifold passageways connecting adjacent tubes, the manifold halves open, and one or both side manifold(s) is/are pulled away from the other. Released from the manifold loop by the open manifold halves, the heating element slides through interior slots 230 as the tubes are pulled from the blanket passageways.

Returning to the embodiment shown in FIGS. 13–16, machine 120 pneumatically threads heating element strands through the guide tubes from a starting guide tube (rightmost tube shown in FIGS. 14 and 17) to a final guide tube (leftmost tube shown in FIGS. 14 and 17) preferably by an air stream provided to the starting guide tube by an air pressure source of approximately 30–50 PSIG, for example a shop air supply (indicated schematically at 133) controlled by a solenoid air valve. Typical shop air provides air at about 120 PSIG. In this case, a regulator may be used to provide the 30–50 PSIG at the guide tubes.

A shuttle 153 (FIG. 18) receives the leading portion of the heating element and is inserted into a port 154 in the starting guide tube. Air flow within guide tubes 128 propels shuttle 153 through the guide tubes and the manifolds, thereby inserting the heating element wire within the blanket shell. Referring to FIG. 18, shuttle 153 has a diameter approximately equal to the passageway diameter within the guide tubes and is constructed from a pair of hemispheres that connect together to hold the end of the heating element.

Referring to FIGS. 14 and 15, the heating element is fed, prior to its insertion into the first guide tube, through a tensioning device 136 that is supported on the right end of frame 122. Tensioning device 136 provides a controlled tension on the wire that inhibits slack in the wire as it is drawn through the blanket shell. A sensor in the tension device outputs a signal to a processor that also controls air source 133. If the sensor detects tension below a certain threshold level indicating that the shuttle is jammed in the guide tubes or manifolds, or above a threshold level indicating that the heating element feed is jammed, the control procedure automatically shuts off the air supply. The particular threshold levels depend on various factors, such as the normal feed tension, air pressure, shuttle construction and heating element construction, and may vary as appropriate for a given arrangement.

As explained above, hinges 125 pivotally connect front closure wall 124*b* with rear wall 124*a*. In operating the machine, wall 124*b* is in the position shown in FIG. 14 so as to close the various passageways and recesses through which shuttle 132 passes in its movement through guide tubes 128. Once shuttle 153 passes through all guide tubes, it is removed from an output port in support 130 at the end of the leftmost guide tube, and the wire is removed from the shuttle by opening the shuttle hemispheres. The upper manifold 129 is then opened to release the wire; platform 148 and tubes 128 are pivoted to the forward position shown in phantom in FIG. 16; the manifold halves in the lower manifold are opened, and the blanket shell is removed from the guide tubes. Like the horizontal guide tubes discussed above with respect to FIG. 19*a* and 19*b*, vertical guide tubes 128 include side slots to allow passage of the wire loops as the blanket is removed from the tubes.

To summarize the operation of blanket wire insertion machine 120, and referring first to FIG. 13, a carriage 144 is positioned in the load/unload position at which a blanket shell is inserted onto guide tubes 128 from the supply of material 129 having passageways formed therein. After moving the material downwardly onto guide tubes 128, the material is cut off to a marked length for a single blanket shell. The carriage then is moved to the left or right, as appropriate, to the position shown in FIGS. 14–16. The operator pivots guide tubes 128 from the position shown in FIGS. 15 and 16 to the vertical position shown in FIG. 14. At the same time, wall 124*b* pivots to the vertical position in which the top ends of guide tubes 128 are positioned adjacent the upper manifold 129 and guide walls 124. The operator then inserts shuttle 153 into port 154 (FIG. 17) after having attached heating wire 134 to the shuttle's trailing end (FIG. 18). The machine propels the shuttle between the upper and lower manifolds until it threads through all of guide tubes 128. At that time, shuttle 153 is driven through the output port—a horizontal passageway (not shown) in support 130 extending from the last guide tube. The operator then opens both manifolds 129 to release the heating element wire and pivots guide tubes 128 to the position shown in FIG. 16, at which time the blanket shell with its associated heating element may be removed upwardly from guide tubes 128.

Figure 20:
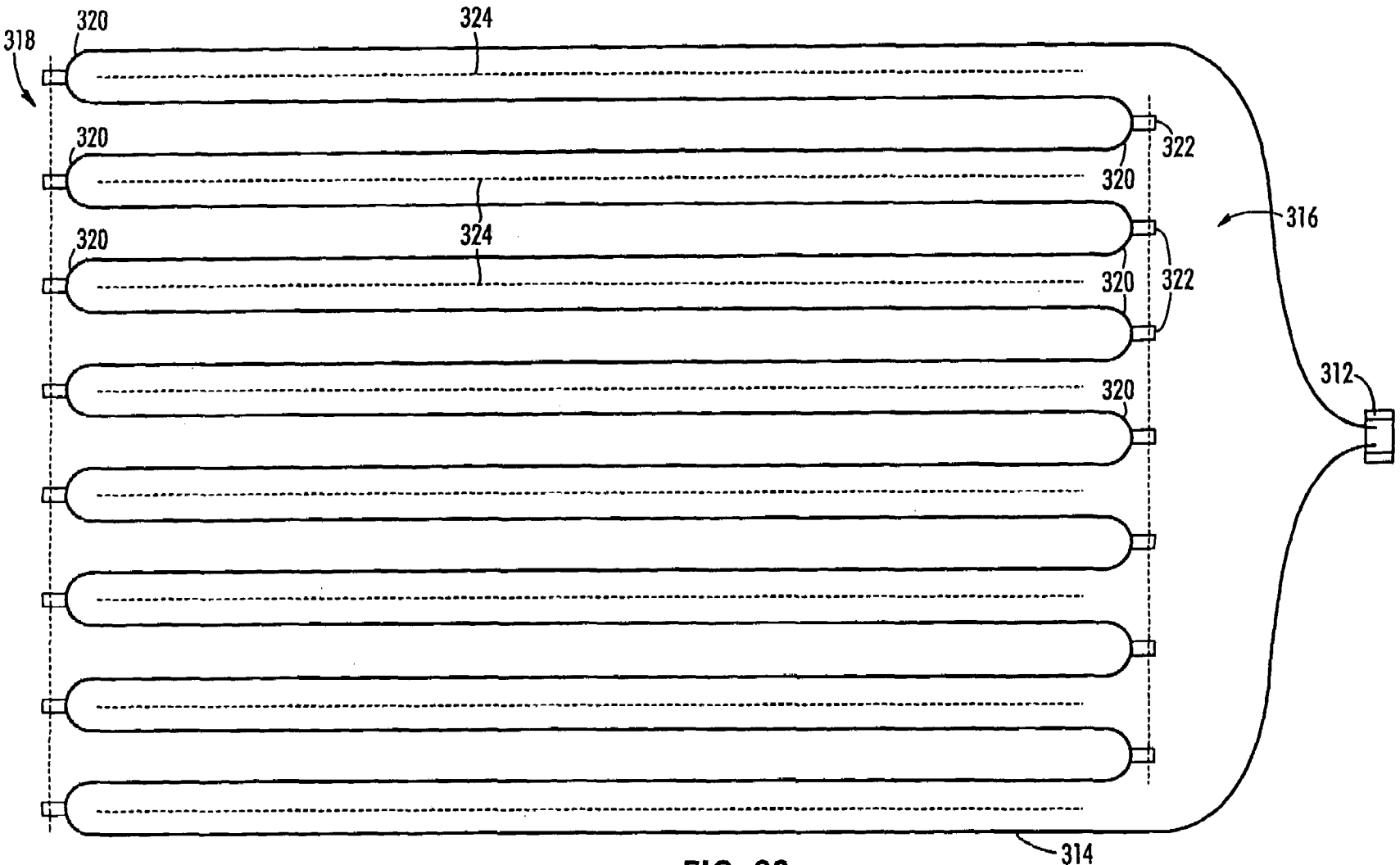
FIG. 20 is a front elevation view of an assembled heating element for use with an electric blanket according to an embodiment of the present invention.

In another preferred embodiment, the heating element is inserted into a blanket shell having parallel passageways by a frame having a series of parallel fingers disposed correspondingly to the passageways in a manner similar to tubes 128 on support 130 (FIGS. 13–16). Referring to FIG. 20, a heating element wire 314 is looped loosely over the tops of the fingers (indicated schematically at 324), and a blanket shell is drawn down over the fingers, in a manner similar to that discussed above with respect to FIG. 13, or the fingers are pushed into the shell. A lateral bar (not shown) attaches to the bottom ends of fingers 324 so that an operator or automated device gripping the frame may push the fingers up into the blanket shell.

As the shell moves over the fingers, the fingers push the heating element wire up into each passageway in a double strand. It will be understood that the heating element slides across the ends of the fingers as the fingers move up into the passageways, and grooves may be provided at the fingers' ends to retain the heating element in position. The operator then cuts the material transversely above the finger tips or, if the shell is already cut, rumples the shell down over the fingers so that the finger tips and wire loops extend through the open ends of the passageways on the shell's other side. The operator inserts hooks or pins into the heating element loops at the finger tips and across the passageway openings to prevent the wire from sliding back into the passageways and pulls the blanket and fingers away from each other so that the fingers exit the passageways.

After the fingers' removal, the blanket is stitched along lines 324 to prevent contact between sides of the individual wire loops in the passageways that might cause a partial short. In one preferred embodiment, sew tabs 322 may be attached at loop ends 320. The tabs are stitched into the blanket selvages along the dashed lines shown at sides 316 and 318 to additionally secure the heating element. A plug 312 electrically attaches to the ends of the heating element, directly or through lead wires, and is folded into the blanket hem.

In another preferred embodiment, the heating element may be inserted into a blanket shell having parallel passageways on a foundation material, such as a scrim layer. Referring to FIG. 21, the heating element wire is deposited onto a scrim layer 326 in a serpentine pattern, for example by hand or by an oscillating dispenser as discussed above with respect to FIG. 9, and is secured to the scrim layer by adhesive or other suitable method, for example stitching or heat welding. The scrim is then cut from the left hand edge of layer 326 up into each wire loop, as indicated at lines 328, so that the layer is segmented into parallel sections. A frame, such as discussed above with respect to FIG. 20, is placed on the foundation layer so that the tips of its fingers (indicated schematically at 324) engage the wire loops. The frame's fingers are then inserted into parallel pocket sections of a blanket segment (not shown) so that a heating element loop is disposed in each pocket. This can be accomplished by pushing the frame into the blanket segment or pulling the blanket segment over the frame. Following the frame's removal, the pockets may be sewn along lines 324 to provide additional separation between the wire in each loop. Sew tabs 322 may be attached at each loop end 320 for stitching into the blanket segment's selvage, which extends from the top and/or bottom half of the blanket segment beyond the passageway openings on either side of the blanket segment.

In another preferred embodiment, however, the sew tabs are omitted, and the foundation scrim layer extends some distance, e.g. six inches, beyond the ends of the wire loops on either side. This selvage material thus extends outward of the passageway openings on either side of the blanket segment. Preferably, the blanket segment's selvage extends from the top and/or bottom of blanket segment, and the scrim extensions are then sewn into the blanket's hem on both sides, thereby securing the scrim foundation and heating element wire in the blanket.

For power efficiency, a metallized MYLAR sheet may be laminated to the side of scrim layer 326 opposite the side to which the heating element is attached, or the scrim layer may include woven metallized fibers. Moreover, it should be understood that a heat reflective sheet, or the use of woven metallized fibers, may be employed with other blanket embodiments as discussed above.

While one or more preferred embodiments of the invention have been described above, it should be understood that any and all equivalent realizations of the present invention are included within the scope and spirit thereof. Thus, the embodiments depicted are presented by way of example only and are not intended as limitations upon the present invention, and it should be understood by those of ordinary skill in this art that the present invention is not limited to these embodiments since modifications can be made. Therefore, it is contemplated that any and all such embodiments are included in the present invention as may fall within the literal or equivalent scope of the appended claims.

What is claimed is:

1. An electric blanket, said electric blanket comprising:

a substrate layer;

a first outer layer heat laminated to said substrate layer;

an elongated heating element disposed between said substrate layer and said first outer layer, said heating element configured to attach to a power source and to generate resistive heat when connected to said power source; and a regulator circuit in communication with said heating element electrically between said power source and said heating element, wherein said regulator circuit is configured to measure rate of change in said heating element of at least one of said heating element's resistance and said heating element's current and to control delivery of electricity from said power source to said heating element responsively to said rate of change.

2. The blanket as in claim 1, wherein said substrate layer is a scrim layer.

3. The blanket as in claim 2, wherein said first outer layer is a first foam layer.

4. The blanket as in claim 3, including a second foam layer laminated to an opposite side of said scrim layer from said first foam layer.

5. The blanket as in claim 3, wherein a layer of oriented fibers are attached to said first foam layer opposite said scrim layer.

6. The blanket as in claim 1, wherein said substrate layer and said first outer layer define a passageway therethrough formed by respective opposing non-laminated surfaces of said substrate layer and said first outer layer, and wherein said heating element is disposed within said passageway.

7. The blanket as in claim 6, wherein said passageway is composed of separate, spaced apart parallel sections of said non-laminated surfaces.

8. The blanket as in claim 7, including a second outer layer laminated to an opposite side of said substrate layer from said first outer layer.

9. The blanket as in claim 8, wherein said substrate layer is a scrim layer, wherein each of said first outer layer and said second outer layer are composed of respective foam layers and wherein said blanket includes respective layers of oriented fibers attached to said foam layers opposite said scrim layer.

10. A method of forming an electric blanket, said method comprising the steps of:

providing a substrate layer;

disposing a first outer layer on a side of said substrate layer;

heat laminating said first outer layer to said substrate layer except at a predetermined position, thereby defining a passageway between said substrate layer and said first outer layer formed by respective opposing non-laminated surfaces of said substrate layer and said first outer layer;

disposing an elongated heating element within said passageway, said heating element configured to attach to a power source and to generate resistive heat when connected to said power source; and providing a regulator circuit in communication with said heating element electrically between said power source and said heating element, wherein said regulator circuit is configured to measure rate of change in said heating element of at least one of said heating element's resistance and said heating element's current and to control delivery of electricity from said power source to said heating element responsively to said rate of change.

11. The method as in claim 10, wherein said laminating step includes passing said substrate layer and said first outer layer through a lamination line extending across said substrate layer and said first outer layer, and wherein said lamination line is disabled at spaced apart sections thereof so that spaced apart parallel sections of said substrate layer and said first outer layer are not laminated.

12. The method as in claim 11, wherein said first outer layer is a first foam layer and wherein said method includes the steps of heat laminating a second foam layer on an opposite side of said substrate layer; and disposing respective layers of oriented fibers to said first and second foam layers opposite said substrate layer.

13. An electric blanket, said electric blanket comprising:

a first scrim substrate layer;

a second scrim substrate layer attached to said first scrim substrate layer;

a first foam outer layer heat laminated to a side of said first scrim substrate layer opposite said second scrim substrate layer;

a second foam outer layer heat laminated to a side of said second scrim substrate layer opposite said first scrim substrate layer;

an elongated heating element disposed between said first scrim substrate layer and said second scrim substrate layer, said heating element configured to attach to a power source and to generate resistive heat when connected to said power source; and a regulator circuit in communication with said heating element electrically between said power source and said heating element, wherein said regulator circuit is configured to measure rate of change in said heating element of at least one of said heating element's resistance and said heating element's current and to control delivery of electricity from said power source to said heating element responsively to said rate of change.

14. The blanket as in claim 13, including respective layers of oriented fibers attached to said first and second foam outer layers opposite said first and second scrim substrate layers.

15. The blanket as in claim 13, wherein said first and second scrim substrate layers are attached by adhesive.

16. The blanket as in claim 13, wherein said first and second scrim substrate layers are attached by heat bonding.

17. A method of making an electric quilt, said method comprising the steps of:

providing a generally rectangular bag;

inserting batting into said bag;

inserting a heating element into said bag, wherein said heating element is configured to generate resistive heat when connected to a power source;

enclosing said bag following said heating element inserting step; and following said enclosing step, sewing a quilt pattern into said bag.

18. The method as in claim 17, including disposing said heating element on a substrate, and wherein said heating element inserting step includes inserting said substrate into said bag.

19. The method as in claim 17, wherein said heating element is inserted into said bag after said batting is inserted into said bag.

20. The method as in claim 18, wherein said substrate is a scrim layer on which is disposed an elongated heating element strand.

21. The method as in claim 18, wherein said heating element is comprised of interwoven conductive weft and warp fibers that at least partially compose said substrate.

22. The method as in claim 17, wherein said heating element includes an electrical connector configured to attach to said power source and deliver electricity from said power source to said heating element and including, following said enclosing step, cutting an opening in said bag to said connector.

* * * * *

UNITED STATES PATENT AND TRADEMARK OFFICE

CERTIFICATE OF CORRECTION

PATENT NO. : 7,115,842 B2
APPLICATION NO. : 10/910102
DATED : October 3, 2006
INVENTOR(S) : Barry P. Keane It is certified that error appears in the above-identified patent and that said Letters Patent is hereby corrected as shown below:

In the Specification:
Column 2, line 16, after “unload”, please add --position;--.

Signed and Sealed this

Twenty-ninth Day of May, 2007

JON W. DUDAS
*Director of the United States Patent and Trademark Office*